US006771154B1

(12) United States Patent
Funayama et al.

(10) Patent No.: US 6,771,154 B1
(45) Date of Patent: Aug. 3, 2004

(54) ELECTROMAGNETIC RELAY

(75) Inventors: Hideo Funayama, Ohtawara (JP); Hiromitsu Sato, Ohtawara (JP)

(73) Assignee: Taiko Device, Ltd., Ohtawara (JP)

( * ) Notice: Subject to any disclaimer, the term of this patent is extended or adjusted under 35 U.S.C. 154(b) by 555 days.

(21) Appl. No.: 09/694,988

(22) Filed: Oct. 25, 2000

(30) Foreign Application Priority Data

| | | |
|---|---|---|
| Nov. 12, 1999 | (JP) | 11-322434 |
| Nov. 12, 1999 | (JP) | 11-322435 |
| Sep. 8, 2000 | (JP) | 2000-272907 |
| Sep. 8, 2000 | (JP) | 2000-272908 |

(51) Int. Cl.[7] ..... H01H 51/22
(52) U.S. Cl. ..... 335/159; 335/78; 335/83; 335/136; 335/162
(58) Field of Search ..... 335/78–86, 136, 335/159–163, 106, 127–132

(56) References Cited

U.S. PATENT DOCUMENTS

| | | | | |
|---|---|---|---|---|
| 1,819,683 A | | 8/1931 | Larsson | |
| 4,427,957 A | | 1/1984 | Sato | 335/19 |
| 4,523,165 A | | 6/1985 | Schedele | 335/106 |
| 4,616,201 A | | 10/1986 | Nagamoto | 335/129 |
| 4,625,191 A | | 11/1986 | Oberndorfer et al. | 335/78 |
| 4,816,794 A | | 3/1989 | Nagao et al. | 335/136 |
| 5,155,459 A | * | 10/1992 | Schmid et al. | 335/128 |
| 5,986,529 A | * | 11/1999 | Miyata et al. | 335/78 |

FOREIGN PATENT DOCUMENTS

| | | |
|---|---|---|
| DE | 12 03 390 B | 10/1965 |
| DE | 195 46 763 A1 | 6/1997 |
| EP | 0 858 151 A1 | 8/1998 |
| GB | 576623 | 11/1943 |
| JP | 46-11499 | 4/1971 |
| JP | A-6-260070 | 9/1994 |

* cited by examiner

*Primary Examiner*—Ramon M. Barrera
(74) *Attorney, Agent, or Firm*—Oliff & Berridge, PLC

(57) ABSTRACT

An electromagnetic relay comprises a coil and a contact group containing a plurality of normally open contacts which are connected in series under control of an electromagnet created when this coil is energized. This electromagnetic relay can prevent a short-circuit from occurring between the normally closed contact and the normally open contact due to an arc even though the contact gap length is reduced.

12 Claims, 18 Drawing Sheets

ELECTROMAGNETIC RELAY

BACKGROUND OF THE INVENTION

1. Field of the Invention

The present invention relates to an electromagnetic relay for use in activating and controlling a direct current (DC) motor for driving a windshield wiper drive section or a power window drive section of automobiles, for example.

2. Description of the Prior Art

Heretofore, DC motor drive circuits using an electromagnetic relay have often been used in order to activate and control a windshield wiper drive section and a power window drive section of automobiles.

FIG. 1 of the accompanying drawings is a schematic circuit diagram showing an example of a prior-art DC motor drive circuit for use in a windshield wiper drive section. FIG. 2 is a schematic circuit diagram showing an example of a prior-art DC motor drive circuit for use in a power window drive section.

First, an example of the DC motor drive circuit for use in the windshield wiper drive section will be described with reference to. FIG. 1.

As shown in FIG. 1, one end of a windshield wiper driving DC motor 1 is connected to a terminal 2*a* connected to a movable contact (this movable contact is usually connected to a suitable means such as a contact spring driven by an armature) AR of an electromagnetic relay 2. The above terminal 2*a* connected to the movable contact AR will hereinafter be referred to as a "movable contact terminal".

The other end of the DC motor 1 is connected to a terminal 2*b* connected to a normally closed contact N/C (i.e. break contact) of the electromagnetic relay 2. The above terminal 2*b* connected to the normally closed contact N/C will hereinafter be referred to as a "normally closed contact terminal". A connection point 2*d* between the other end of the DC motor 1 and the normally closed contact 2*b* is connected to the ground.

A terminal 2*m* connected to a normally open contact N/O (i.e. make contact) of the electromagnetic relay 2 is connected to a power supply at a terminal 3, at which a positive DC voltage (+B) is supplied from a car battery. The above terminal 2*m* to which the normally open contact N/O is connected will hereinafter be referred to as a "normally open contact terminal".

The electromagnetic relay 2 includes a coil 2C. The coil 2C is energized or de-energized by control current supplied from a windshield wiper drive controller 4 when a user operates a windshield wiper switch 5. This windshield wiper switch 5 includes three fixed contacts 5*a*, 5*b*, 5*c* and a movable contact 5*m*.

When the windshield wiper switch 5 connects the movable contact 5*m* to the fixed contact 5*a* ("OFF" position), the coil 2C is not energized by controlling current from the windshield wiper drive controller 4 so that the electromagnetic relay 2 connects the movable contact AR to the normally closed contact N/C. As a result, one end and the other end of the DC motor 1 are connected to each other and thereby the DC motor 1 can be braked (or placed in the stationary state).

When the windshield wiper switch 5 connects the movable contact 5*m* to the fixed contact 5*b* ("INTERMITTENT" position), the coil 2C of the electromagnetic relay 2 is intermittently energized by the controlling current from the windshield wiper drive controller 4. As a result, the electromagnetic relay 2 connects the movable contact AR to the normally open contact N/O while the coil 2C is being energized by the control current. When the coil 2C is not energized by the control current, the electromagnetic relay 2 connects the movable contact AR to the normally closed contact N/C. Specifically, the electromagnetic relay 2 alternately connects the movable contact AR to the normally closed contact N/C and the normally open contact N/O each time the coil 2C is energized or is not energized.

When the electromagnetic relay 2 connects the movable contact AR to the normally open contact N/O, direct current flows through the DC motor 1 as shown by a solid-line arrow I in FIG. 1 and thereby the DC motor 1 can be driven. When the electromagnetic relay 2 connects the movable contact AR to the normally closed contact N/C, the supply of the direct current I to the DC motor 1 is interrupted and the DC motor 1 becomes a generator of direct current so that direct current flows through the DC motor 1 in the direction opposite to that of the direct current I and the DC motor 1 can be braked, i.e. the DC motor 1 can be driven intermittently. As this DC motor 1 is driven intermittently, the windshield wiper is driven intermittently.

When the windshield wiper switch 5 connects the movable contact 5*m* to the fixed contact 5*c* ("CONTINUOUS" position), the coil 2C of the electromagnetic relay 2 is continuously energized by the controlling current from the windshield wiper drive controller 4. As a result, the electromagnetic relay 2 connects the movable contact AR to the normally open contact N/O to permit the direct current to flow through the DC motor 1 continuously as shown by the solid-line arrow I in FIG. 1. Therefore, the windshield wiper can be driven continuously.

When the windshield wiper switch 5 connects the movable contact 5*m* to the fixed contact 5*a* ("OFF" position), the coil 2C of the electromagnetic relay 2 is not energized so that the electromagnetic relay 2 connects the movable contact AR to the normally closed contact N/C. Therefore, the DC motor 1 becomes a direct current generator to allow current to flow through the DC motor 1 in the direction opposite to the direction in which the direct current flows as shown by the solid-line arrow I in FIG. 1. Thus, the DC motor 1 can be braked and stopped.

Next, an example of a conventional DC motor drive circuit for use in a power window drive section will be described next with reference to FIG. 2.

Referring to FIG. 2, one end of a power window DC motor 11 is connected to a movable contact terminal 12*a* of an electromagnetic relay 12 that can move the power window upward. The other end of the DC motor 11 is connected to a movable contact terminal 13*a* of an electromagnetic relay 13 that can move the power window downward.

A normally closed contact terminal 12*b* of the electromagnetic relay 12 and a normally closed contact terminal 13*b* of the electromagnetic relay 13 are connected to each other. A connection point 12*d* between the normally closed contact terminal 12*b* and the normally closed contact terminal 13*b* is connected to the ground. A normally open contact terminal 12*m* of the electromagnetic relay 12 and a normally open contact terminal 13*m* of the electromagnetic relay 13 are connected to each other. A connection point 12*e* between the normally open contact terminal 12*m* and the normally open contact terminal 13*m* is connected to the power supply at the terminal 3, at which a positive DC voltage (+B) is connected from a car battery, for example.

The coil 12C of the electromagnetic relay 12 is energized by controlling current supplied from a power window ascending controller 14 when a user operates the power window drive section to move the power window upward. The coil 13C of the electromagnetic relay 13 is energized by controlling current supplied from a power window descending controller 16 when the user operates the power window drive section to move the power window downward.

Specifically, while the user is operating the power window drive section to move the power window upward, a switch 15 is continuously energized so that the coil 12C of the electromagnetic relay 12 is energized by the controlling current from the power window ascending controller 14, permitting the electromagnetic relay 12 to connect the movable contact AR to the normally open contact N/O. Therefore, a DC current flows through the DC motor 11 in the direction shown by a solid-line arrow I1 in FIG. 2 and thereby the DC motor 11 can be driven in the positive direction, for example. Therefore, the power window of the automobile can be moved upward, i.e. in the power window closing direction.

When the user stops operating the power window drive section to move the power window upward, the switch 15 is de-energized so that the coil 12C of the electromagnetic relay 12 is not energized by the control current, permitting the electromagnetic relay 12 to connect the movable contact AR to the normally closed contact N/C. As a result, the DC motor 11 can be braked and thereby the upward movement of the power window can be stopped.

While the user is operating the power window drive section to move the power window downward, a switch 17 is continuously energized so that the coil 13C of the electromagnetic relay 13 is energized by the controlling current from the power window descending controller 16 to permit the electromagnetic relay 13 to connect the movable contact AR to the normally open contact N/O. Therefore, direct current flows through the DC motor 11 in the direction shown by a dashed-line arrow I2 in FIG. 2 and the DC motor 11 can be driven in the opposite direction. Thus, the power window can be moved downward, i.e. in the power window opening direction.

When the user stops operating the power window drive section to move the power window downward, the switch 17 is de-energized so that the coil 13C of the electromagnetic relay 13 is not energized by the control current, permitting the electromagnetic relay 13 to connect the movable contact AR to the normally closed contact N/C. Therefore, the DC motor 11 can be braked and thereby the downward movement of the power window can be stopped.

In this manner, the conventional DC motor drive circuit uses one contact group of the electromagnetic relay and energizes the coil of the electromagnetic relay to connect the movable contact AR to the normally open contact N/O to drive the DC motor. On the other hand, the conventional DC motor drive circuit de-energizes the coil of the electromagnetic relay to connect the movable contact AR to the normally closed contact N/C to brake the DC motor.

In the electromagnetic relay used in this kind of DC motor drive circuit, while the coil is being de-energized to release the electromagnetic relay since direct current has flowed to the DC motor through the normally open contact N/O of the electromagnetic relay, when the movable contact AR separates from the normally open contact N/O, an arc occurs between the normally open contact N/O and the movable contact AR. If a gap length between the movable contact AR and the normally open contact N/O in the released state of the electromagnetic relay (this gap length will hereinafter be referred to as a "contact gap length" for simplicity) is not sufficient, when the electromagnetic relay is released, the movable contact AR comes in contact with the normally closed contact N/C before the arc occurring between the normally open contact N/O and the movable contact AR is cut off. As a consequence, the normally closed contact N/C and the normally open contact N/O of the contact group are short-circuited (shorted). Unavoidably, the electromagnetic relay will be degraded and some suitable circuit elements such as a control circuit mounted on the same printed circuit board as this electromagnetic relay will be destroyed.

To overcome the above-mentioned disadvantages encountered with the prior-art electromagnetic relay, the contact gap length has hitherto been determined in accordance with the value of voltage (value of battery voltage) applied to the power supply at the terminal 3. Ordinary automobiles can be activated by a standard car battery of DC 12V and are able to drive the above DC motor drive circuit by an electromagnetic relay having a contact gap length of 0.3 mm, for example. Large automobiles such as a truck and a bus can be activated by a car battery of a high voltage higher than 24V (maximum voltage value is 32V), for example. Therefore, such large automobiles require an electromagnetic relay in which the contact gap length is longer than 1.2 mm, for example, to drive the above DC motor drive circuit.

Therefore, according to the prior art, since the contact gap length increases as the power supply voltage increases, it is unavoidable that the electromagnetic relay becomes large in size. Such large electromagnetic relay becomes troublesome when it is mounted on the printed circuit board. Moreover, since the stroke of the movable contact AR of such large electromagnetic relay lengthens, it is unavoidable that an operating speed of an electromagnetic relay decreases. In particular, recently, as so-called hybrid cars, which can be driven by an engine using electricity together with gasoline and electric cars become commercially available on the market, the voltage of the car battery becomes high increasingly. Therefore, the above-mentioned problem becomes considerably serious.

SUMMARY OF THE INVENTION

In view of the aforesaid aspects, it is an object of the present invention to provide an electromagnetic relay in which an arc cut-off capability can be improved without increasing a contact gap length.

In this specification, a capability of an electromagnetic relay for cutting off an arc occurred when a movable contact of an electromagnetic relay separates from a normally open contact before the movable contact is connected to the normally closed contact will be referred to as an "arc cut-off capability".

It is another object of the present invention to provide a DC motor drive circuit using this electromagnetic relay in which a short-circuit caused by an arc can be avoided even when a high power supply voltage is applied to the electromagnetic relay.

According to an aspect of the present invention, there is provided an electromagnetic relay which is comprised of a coil and a contact group containing a plurality of normally open contacts which are connected in series when the contact group is switched under electromagnetic control of the coil.

In accordance with another aspect of the present invention, there is provided an electromagnetic relay which is comprised of a coil, a normally closed contact, a plurality of movable contacts containing a movable contact which is connected to the normally closed contact when the coil is not energized, a plurality of normally open contacts provided in correspondence with a plurality of movable contacts and an armature driven under electromagnetic control effected when the coil is energized to thereby simultaneously displace a plurality of movable contacts so that a plurality of movable contacts are connected to a plurality of normally open contacts.

According to the DC motor drive circuit using the inventive electromagnetic relay thus arranged, when the coil of the electromagnetic relay is energized by the control current in order to drive the DC motor and the electromagnetic relay connects its movable contact to the normally open contact to permit the direct current to be supplied to the DC motor, the direct current is supplied through a plurality of normally open contacts connected in series to the DC motor.

Accordingly, since a circuit voltage obtained when the electromagnetic relay is released after the supply of control current to the coil of the electromagnetic relay has been stopped is applied to a plurality of gaps between the movable contacts (the movable contact is connected to the normally closed contact when the electromagnetic relay is fully released) and the normally open contacts connected in series, the voltage applied to each gap is divided by the number of the normally open contacts connected in series and therefore decreases.

Therefore, when the supply of control current to the coil of the electromagnetic relay is stopped and the electromagnetic relay is released, even if the arc occurs between the movable contact and the normally open contact N/O, the voltage applied to each of a plurality of gaps between the movable contacts and the normally open contacts connected in series decreases so that the problem of short caused by the arc can be solved even though the contact gap length is reduced.

According to the electromagnetic relay of the present invention, a plurality of movable contacts separate from a plurality of normally open contact N/O connected in series at the same time and therefore the separating speed of the movable contact can increase equivalently.

As described above, according to the present invention, since a plurality of normally open contacts, each having a short contact gap length, are connected in series so that the length of contact gap to which the power supply voltage is applied can increase equivalently, even when the electromagnetic relay with the short contact gap length is used, the arc occurring when the movable contact of the electromagnetic relay separates from the normally open contact can be cut off before the movable contact is returned to the normally closed contact side. Specifically, even the electromagnetic relay with the short contact gap length can improve the arc cut-off capability.

As set forth above, according to the electromagnetic relay of the present invention, since the arc cut-off capability of the electromagnetic relay is improved, even when a power supply voltage of a circuit increases, there can be used the electromagnetic relay whose contact gap length is reduced.

Furthermore, according to the electromagnetic relay of the present invention, since a plurality of normally open contacts are connected in series within a single electromagnetic relay, fluctuations of timing at which the movable contact separate from these normally open contacts connected in series can be decreased with ease and therefore the arc cut-off capability can be improved much more.

DESCRIPTION OF THE PREFERRED EMBODIMENTS

An electromagnetic relay and a DC motor drive circuit using such an electromagnetic relay according to the present invention will be described below with reference to the accompanying drawings. In the present invention, the electromagnetic relay and the DC motor drive circuit using the electromagnetic relay may be applied to the aforementioned windshield wiper drive section and power window drive section.

Figure 3:
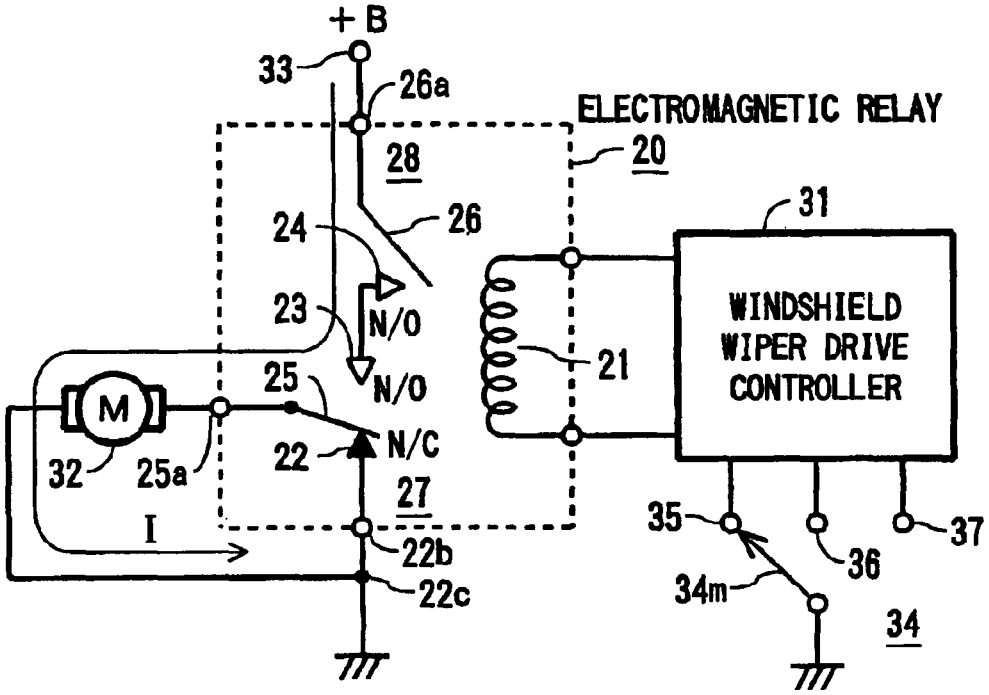
FIG. 3 is a schematic circuit diagram of a DC motor drive circuit using an electromagnetic relay according to an embodiment of the present invention.

FIG. 3 is a schematic circuit diagram showing an equivalent circuit of an electromagnetic relay used when the present invention is applied to a windshield wiper drive controller and a DC motor drive circuit using such an electromagnetic relay to drive a windshield wiper drive section.

According to this embodiment, as shown in FIG. 3, when an electromagnetic relay 20 for driving a windshield wiper is energized under control of a windshield wiper drive controller 31, a DC motor 32 for driving a windshield wiper can be driven and braked.

As shown in FIG. 3, the electromagnetic relay 20 includes a coil 21, a normally closed contact 22, two normally open contacts 23, 24 and two movable contacts 25, 26. The normally closed contact 22, the normally open contact 23 and the movable contact 25 constitutes a first contact group 27, and the normally open contact 24 and the movable contact 26 constitutes a second contact group 28. The two normally open contacts 23, 24 are electrically connected in series. The two movable contacts 25, 26 are moved simultaneously in unison with each other under control of the coil 21.

Although the two normally open contacts 23, 24 are electrically connected in series by connecting terminals led out from the two normally open contacts 23, 24 to the outside of the housing of the electromagnetic relay 20, in the electromagnetic relay 20 according to this embodiment, no external terminals are led out from the two normally open contacts 23, 24 but instead, the two normally open contacts 23, 24 are electrically connected in series within the housing of the electromagnetic relay 20.

One end of the windshield wiper driving DC motor 32 is connected to a movable contact terminal 25*a* connected to the movable contact 25 of the first contact group 27 of the electromagnetic relay 20. The other end of the DC motor 32 is connected to a normally closed contact terminal 22*b* connected to the normally closed contact 22 of the first contact group 27 of the electromagnetic relay 20. A connection point 22*c* between the other end of the DC motor 32 and the normally closed contact 22*b* is connected to one power supply terminal, i.e. the ground.

A movable contact terminal 26*a* with the movable contact 26 of the second contact group 28 of the electromagnetic relay 20 connected thereto is connected to the other power supply terminal, i.e. the power supply at a terminal 33, at which a positive DC voltage (+B) of 24V, for example, is connected from the car battery (not shown).

The coil 21, which can simultaneously control the two contact groups 27, 28 of the electromagnetic relay 20 in unison with each other, is energized by controlling current supplied from the windshield wiper drive controller 31 in response to the status in which a windshield wiper switch 34 is placed when a user operates the windshield wiper switch 34. The windshield wiper switch 34 includes three fixed contacts 35, 36, 37 and a movable contact 34*m*.

Operation of the DC motor drive circuit shown in FIG. 3 will be described below.

When the windshield wiper switch 34 connects the movable contact 34*m* to the fixed contact 35 ("OFF" position), since the coil 21 is not energized by controlling current from the windshield wiper drive controller 31, the electromagnetic relay 20 is released to connect the movable contact 25 of the first contact group 27 to the normally closed contact 22 and separate the movable contact 26 of the second contact group 28 from the normally open contact 24. Consequently, both ends of the DC motor 32 are connected to each other through the normally closed contact 22 of the first contact group 27 so that the DC motor 32 can be braked.

When the windshield wiper switch 34 connects the movable contact 34*m* to the fixed contact 36 ("INTERMITTENT" position), the coil 21 of the electromagnetic relay 20 is intermittently energized by controlling current supplied from the windshield wiper drive controller 31. Then, the electromagnetic relay 20 connects the movable contacts 25 and 26 of the two contact groups 27, 28 to the normally open contacts 23, 24 nearly simultaneously in unison with each other while the coil 21 is being energized by the control current. When the coil 21 is not energized by the control current, the electromagnetic relay 20 separates the respective movable contacts 25, 26 from the normally open contacts 23, 24 nearly simultaneously in unison with each other and thereby the movable contacts 25, 26 are returned to the original state nearly at the same time.

When the electromagnetic relay 20 connects the movable contacts 25, 26 of the two contact groups 27, 28 to the normally open contacts 23, 24, respectively, the DC motor 32 is actuated by direct current I shown by a solid-line arrow I in FIG. 3 and thereby the DC motor 32 can be driven. When the electromagnetic relay 20 returns the movable contacts 25, 26 of the two contact groups 27, 28 to the original state, the DC motor 32 can be braked. Specifically, the DC motor 32 can be driven intermittently, and the windshield wiper can be driven intermittently as the DC motor 32 is driven intermittently.

When the windshield wiper switch 34 connects the movable contact 34*m* to the fixed contact 37 ("CONTINUOUS" position), the coil 21 of the electromagnet relay 20 is continuously energized by the controlling current from the windshield wiper drive controller 31. As a consequence, the electromagnetic relay 20 connects the movable contacts 25, 26 of the two contact groups 27, 28 to the respective normally open contacts 23, 24 nearly simultaneously in unison with each other so that the DC motor 32 is continuously actuated by the controlling current I shown by the solid-line arrow I in FIG. 3. Thus, the windshield wiper can be driven continuously.

When the windshield wiper switch 34 returns the movable contact 34*m* to the fixed contact 35 ("OFF" position), the coil 21 is not energized by the controlling current. Therefore, the electromagnetic relay 20 returns the movable contacts 25, 26 of the two contact groups 27, 28 to the original state nearly simultaneously in unison with each other, i.e. the electromagnetic relay 20 connects the movable contact 25 to the normally closed contact 22 and separates the movable contact 26 from the normally open contact 24.

In this case, the paragraph "the movable contacts 25, 26 of the two contact groups 27, 28 are returned to the original state nearly simultaneously in unison with each other" means that the movable contact 26 of the second contact group 28 is separated from the normally open contact 24 before at least the movable contact 25 of the first contact group 27 is separated from the normally open contact 23 and connected to the normally closed contact 22. In other words, the above paragraph can be understood such that the movable contact 25 is returned to the normally closed contact 22 since the movable contacts 25, 26 had been brought in contact with neither the normally open contact N/O nor the normally closed contact N/C at the same time.

Specifically, when a plurality of movable contacts are simultaneously returned to the original state in unison with each other, a plurality of movable contacts need not always be separated from the normally open contact N/O exactly at the same time. In short, the above paragraph means that a plurality of movable contacts are brought in contact with neither the normally open contact N/O nor the normally closed contact N/C at the same time. This relationship applies for other embodiments, which will be described later on, as well.

In the embodiment shown in FIG. 3, the normally open contact 23 of the first contact group 27 in the electromagnetic relay 20 is connected through the normally open contact 24 of the second contact group 28 to the power supply terminal 33, and the two normally open contacts N/O are connected in series to the current passage of the direct current I which energizes the DC motor 32.

Therefore, when the respective movable contacts 25, 26 of the first and second contact groups 27, 28 are returned to the original state nearly at the same time in unison with each other, if an arc occurs between the movable contacts 25, 26 and the normally open contact N/O, then the power supply voltage is applied to the two contact gaps of the two contact groups 27, 28. Thus, the power supply voltage may be divided and the voltage applied to the gap per contact group may decreased to ½. Hence, even when the length of the contact gap in each of the contact groups 27, 28 is reduced, the aforementioned disadvantage of the short-circuit caused by the arc can be avoided.

In addition, according to the arrangement in which a plurality of normally open contacts whose contact gap lengths are short are connected in series, a speed (hereinafter referred to as a separating speed) at which the movable contacts are separated from the normally open contacts and returned to the stationary state can be increased equivalently. Specifically, in the electromagnetic relay according to the present invention, since a plurality of normally open contacts whose contact gap lengths are reduced are connected in series, the length of the contact gap to which the power supply voltage is applied can be increased equivalently. Then, since the respective normally open contacts connected in series are separated from the movable contacts nearly at the same time, such separating speed with respect to the contact gap having this equivalent length can be increased as compared with the case in which the contact gap having that equivalent length is realized by one contact group.

Therefore, according to this embodiment, even when the electromagnetic relay has the short contact gap length, such electromagnetic relay can improve the arc cut-off capability.

Therefore, according to the electromagnetic relay of this embodiment, since the contact gap length need not be increased even when the voltage of the battery increases, the electromagnetic relay can be miniaturized. Moreover, since the contact gap length need not be increased even when the voltage of the car battery increases, the electromagnetic relay can increase its operating speed.

The present invention is not limited to the arrangement shown in FIG. 3, and such a variant is also possible. Specifically, as shown in FIG. 3, the normally open contact 23 of the first contact group 27 is connected to the movable contact 26 of the second contact group 28 and the normally open contact 24 of the second contact group 28 is connected to the power supply terminal 33 with similar action and effects being achieved with respect to the arc cut-off capability. However, if the normally open contacts 23, 24 of the first and second contact groups 27, 28 are connected together like the embodiment shown in FIG. 3, then assemblies of the electromagnetic relay can be decreased as will be understood from the following description of the electromagnetic relay 20, and therefore the structure of the electromagnetic relay 20 can be simplified.

Figure 4:
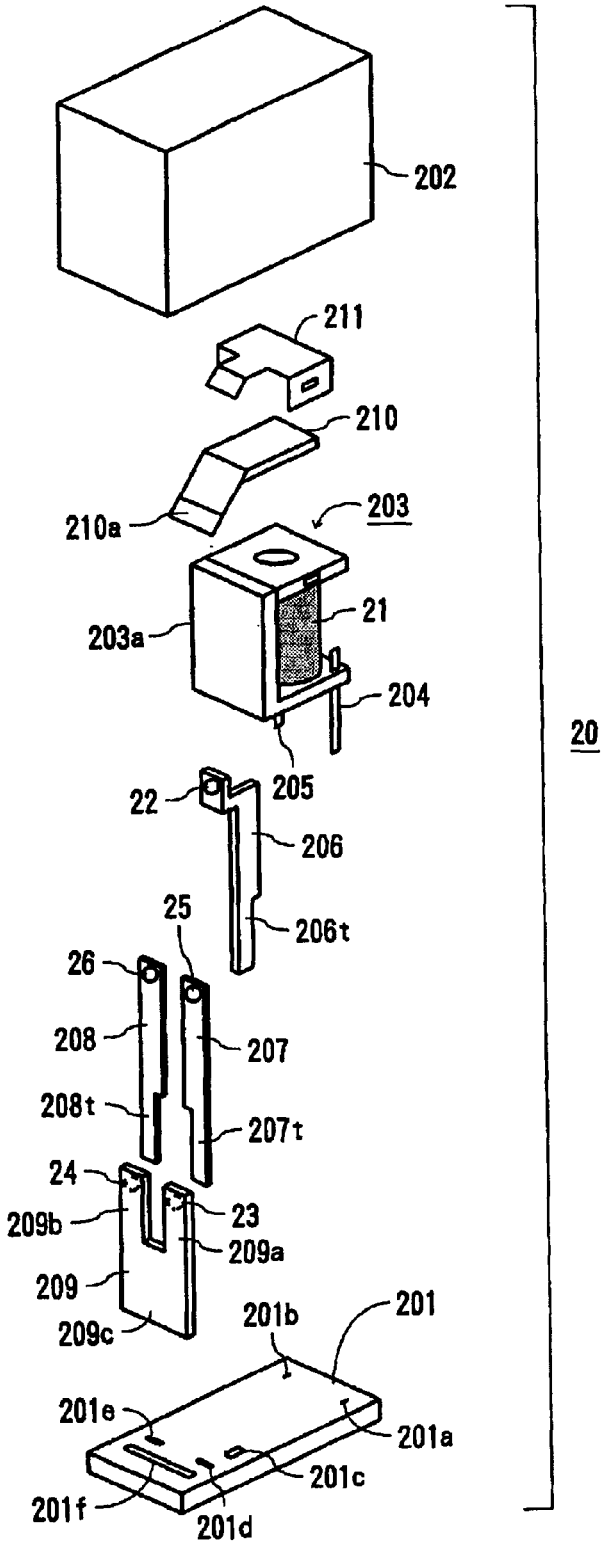
FIG. 4 is an exploded, perspective view showing an example of the structure of the electromagnetic relay shown in FIG. 3.

FIG. 4 is a perspective view showing an example of the structure of the windshield wiper drive and control electromagnetic relay 20 shown in FIG. 3, and illustrates the electromagnetic relay 20 in an exploded fashion. In FIG. 4, elements and parts identical to those of FIG. 3 are marked with identical reference numerals.

As shown in FIG. 4, assemblies of the electromagnetic relay 20 are assembled on a terminal board 201. Assembled parts are covered with a cover 202 when the cover 202 is joined to the terminal board 201. The housing of the electromagnetic relay 20 is comprised of the terminal board 201 and the cover 202.

Figure 5:
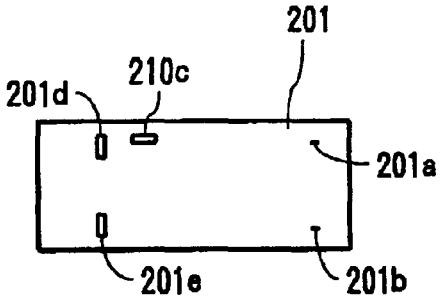
FIG. 5 is a rear view showing a part of the electromagnetic relay shown in FIG. 4.

FIG. 5 is a rear view of the terminal board 201, and illustrates through-holes 201*a*, 201*b*, 201*c*, 201*d*, 201*e* from which terminals (not shown) are led out to the outside of the housing of the electromagnetic relay 20.

As shown in FIG. 4, an electromagnet assembly 203 is arranged such that the coil 21 with an iron-core is supported by an L-shaped yoke 203*a*. This electromagnet assembly 203 includes coil terminals 204, 205 made of a conductive material to which one end and the other end of the coil 21 are connected, respectively. The conductive coil terminals 204, 205 are extended through the terminal board 201 from the through-holes 201*a*, 201*b* to the outside of the housing of the electromagnetic relay 20.

A normally closed contact plate 206 is made of a conductive material, and the normally closed contact 22 is formed on the normally closed contact plate 206. In this embodiment, a normally closed contact terminal 206*t* is integrally formed with the normally closed contact plate 206. This normally closed contact terminal 206*t* is extended through the terminal board 201 from the through-hole 201*c* to the outside of the housing of the electromagnetic relay 20.

Movable contact springs 207, 208 are made of a conductive material. The movable contact 25 is formed on the movable contact spring 207, and the movable contact 26 is formed on the movable contact spring 208. In this embodiment, the movable contact terminals 207*t*, 208*t* are integrally formed with these movable contact springs 207, 208. The movable contact terminal 207*t* is extended through the terminal board 201 from the through-hole 201*d* to the outside of the housing of the electromagnetic relay 20. The movable contact terminal 208*t* is extended through the terminal board 201 from the through-hole 201*e* to the outside of the housing of the electromagnetic relay 20.

A common normally open contact plate 209 is a contact plate made of a conductive material. This common normally open contact plate 209 is comprised of a normally open contact portion 209*a* on which the normally open contact 23 of the first contact group 27 is formed, a normally open contact portion 209*b* on which the normally open contact 24 of the second contact group 28 is formed and a base portion 209*c* from which the above normally open contact portions 209*a*, 209*b* are elongated. Specifically, the normally open contact 23 of the first contact group 27 and the normally open contact 24 of the second contact group 28 are formed on the commmon normally open contact plate 209 which is arranged as a common single conductive plate portion. Therefore, the normally open contacts 23, 24 are electrically connected to each other.

This common normally open contact plate 209 is fitted into a concave groove 201*f* formed on the terminal board 201. However, no terminal is led out from this common normally open contact plate. 209 to the outside of the housing of the electromagnetic relay 20.

An armature 210 is made of a magnetic material and attached to the electromagnet assembly 203 by a hinge spring 211. According to this embodiment, this armature 210 includes an armature card-like portion 210*a*. When the armature 210 is attracted and moved toward the electromagnet assembly 203 by a magnetic attraction from an electromagnet created when the coil 21 is energized by current, the armature card-like portion 210*a* is caused to displace the two movable contact springs 207, 208 toward the common normally open contact plate 209 at the same time as shown by an arrow A1 in FIG. 6.

With the above arrangement of the electromagnetic relay 20, under the condition that the coil 21 is not energized, the armature 210 is not attracted toward the electromagnet assembly 203 so that the movable contact springs 207, 208 are not displaced toward the common normally open contact plate 209. As a consequence, the normally closed contact 22 and the movable contact 25 of the first contact group 27 are connected to each other, and the movable contact 26 of the second contact group 28 is separated from the normally open contact 24.

Figure 6:
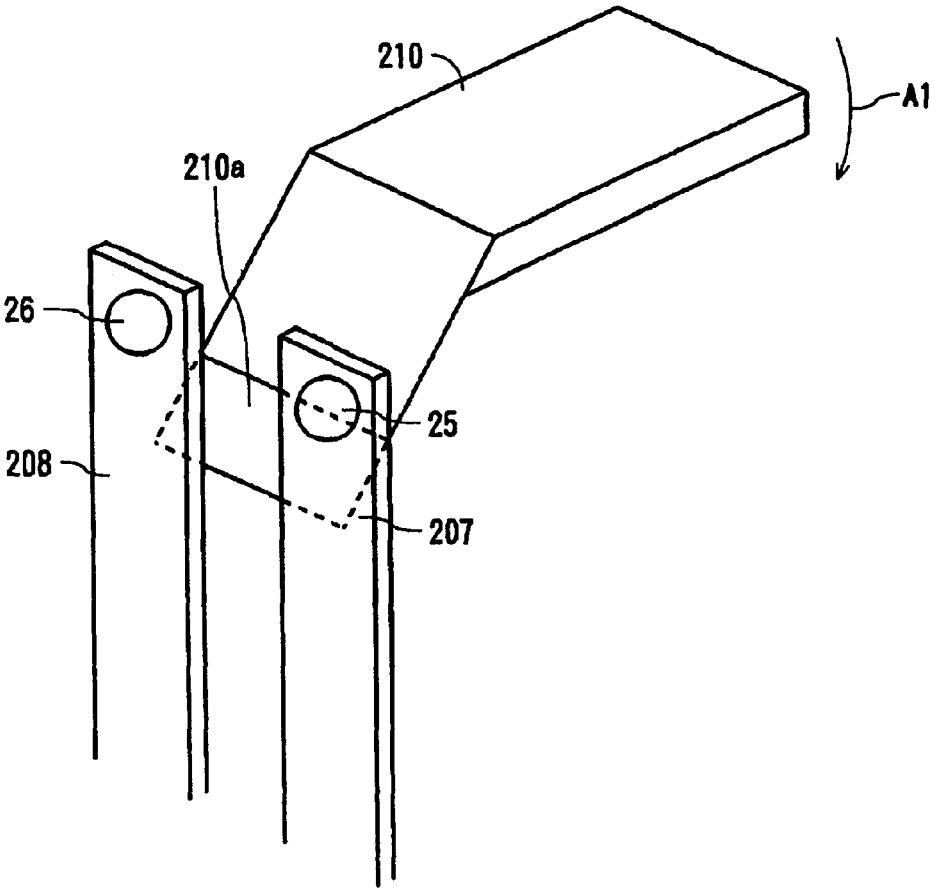
FIG. 6 is a fragmentary, perspective view to which reference will be made in explaining operation of the electromagnetic relay shown in FIG. 4.

When the coil 21 is energized by current through the coil terminals 204, 205, the armature 210 is attracted by the electromagnet assembly 203 so that the armature card-like portion 21*a* at the tip of this armature 210 is urged to displace the two movable contact springs 207, 208 toward the common normally open contact plate 209 at the same time as shown by the arrow A1 in FIG. 6.

When the movable contact spring 207 is resiliently displaced by the armature card-like portion 210*a* of the armature 210, the movable contact 25 of the first contact group 27 is separated from the normally closed contact 22 and is connected to the normally open contact 23 of the normally open contact portion 209*a* of the common normally open contact plate 209. When the movable contact spring 208 is resiliently displaced by the armature card-like portion 210*a* of the armature 210, the movable contact 26 of the second contact group 27 is connected to the normally open contact 24 of the normally open contact portion 209*b* of the common normally open contact plate 209.

Therefore, the two normally open contacts 23, 24 can be connected in series between the movable contact terminal 207*t* of the movable contact spring 207 and the movable contact terminal 208*t* of the movable contact spring 208.

When the coil 21 is not energized by current, a magnetic attraction exerted upon the armature 210 from the electromagnet assembly 203 is withdrawn so that the resilient displacement force exerted upon the movable contact springs 207, 208 from the armature 210 also is withdrawn. As a consequence, the movable contact springs 207, 208 are separated from the normally open contacts 23, 24 of the common normally open contact plate 209 nearly at the same time by their spring force and returned to the original state, in which state the movable contact 25 of the first contact group 27 is connected to the normally closed contact 22 and the movable contact 26 of the second contact group 28 is separated from the normally open contact 24.

At that very moment, when the electromagnetic relay 20 is connected in the same manner as the DC motor drive circuit is connected as shown in FIG. 3, the equivalent length of the contact gap to which the power supply voltage is applied becomes equal to a sum of a contact gap length g1 between the movable contact 25 of the first contact group 27 and the normally open contact 23 of the normally open contact portion 209*a* and a contact gap length g2 between the movable contact 26 of the second contact group 28 and the normally open contact 23 of the normally open contact portion 209*b*. As a consequence, the voltage at the power supply is divided and the voltages thus divided can be applied to the respective contact gap lengths g1, g2. Therefore, the contact gap lengths g1, g2, which can demonstrate a sufficiently satisfactory arc cut-off capability, can decrease as compared with the case in which the voltage at the power supply is applied to the single contact gap.

In this embodiment, since the contact gap length necessary for the electromagnetic relay 20 is g1 (or g2 where g1 and g2 are nearly equal), the contact gap length can be reduced to almost ½ as compared with the case of the contact gap of the single contact group. Therefore, the electromagnetic relay 20 according to this embodiment can be miniaturized.

In the case of the electromagnetic relay 20 according to this embodiment, since the normally open contacts 23, 24 of the first and second contact groups 27, 28 are formed on the common normally open contact plate 209, the assemblies of the electromagnetic relay 20 can decrease, and the electromagnetic relay 20 can be simplified in structure.

In order to connect the two normally open contacts in series, the normally open contact portions 209*a*, 209*b* are independently prepared and electrically connected to each other within the housing of the electromagnetic relay 20. Alternatively, terminals are respectively led out from the normally open contact portions 209*a*, 209*b* to the outside of the housing of the electromagnetic relay 20 and electrically connected to each other. Furthermore, if the normally open contact portion 209*a* and the movable contact spring 208 are electrically connected to each other and a terminal is led out from the normally open contact portion 209*b*, then two normally open contacts can be connected in series between the movable contact terminal 207*t* of the movable contact spring 207 and the terminal led out from the normally open contact portion 209*b*.

The above variations of the connection method, however, needs two normally open contact members and also needs an electrical connection process. On the other hand, according to the electromagnetic relay 20 using the common normally open contact plate 209 of the embodiment shown in FIG. 4, there is required one piece of assembly as the normally open contact member, and the process for electrically connecting the normally open contact portions 209*a*, 209*b* can be omitted.

Moreover, according to the electromagnetic relay 20 of the embodiment shown in FIG. 4, since the single armature 210 (armature card-like portion 210*a* of the armature 210) can resiliently displace the two movable contact springs 207, 208 at the same time, the electromagnetic relay 20 needs only one coil and can easily satisfy the necessary condition for improving the arc cut-off capability, i.e. "the movable contacts 25, 26 should be separated from the two normally open contacts 23, 24 nearly at the same time".

Figure 7:
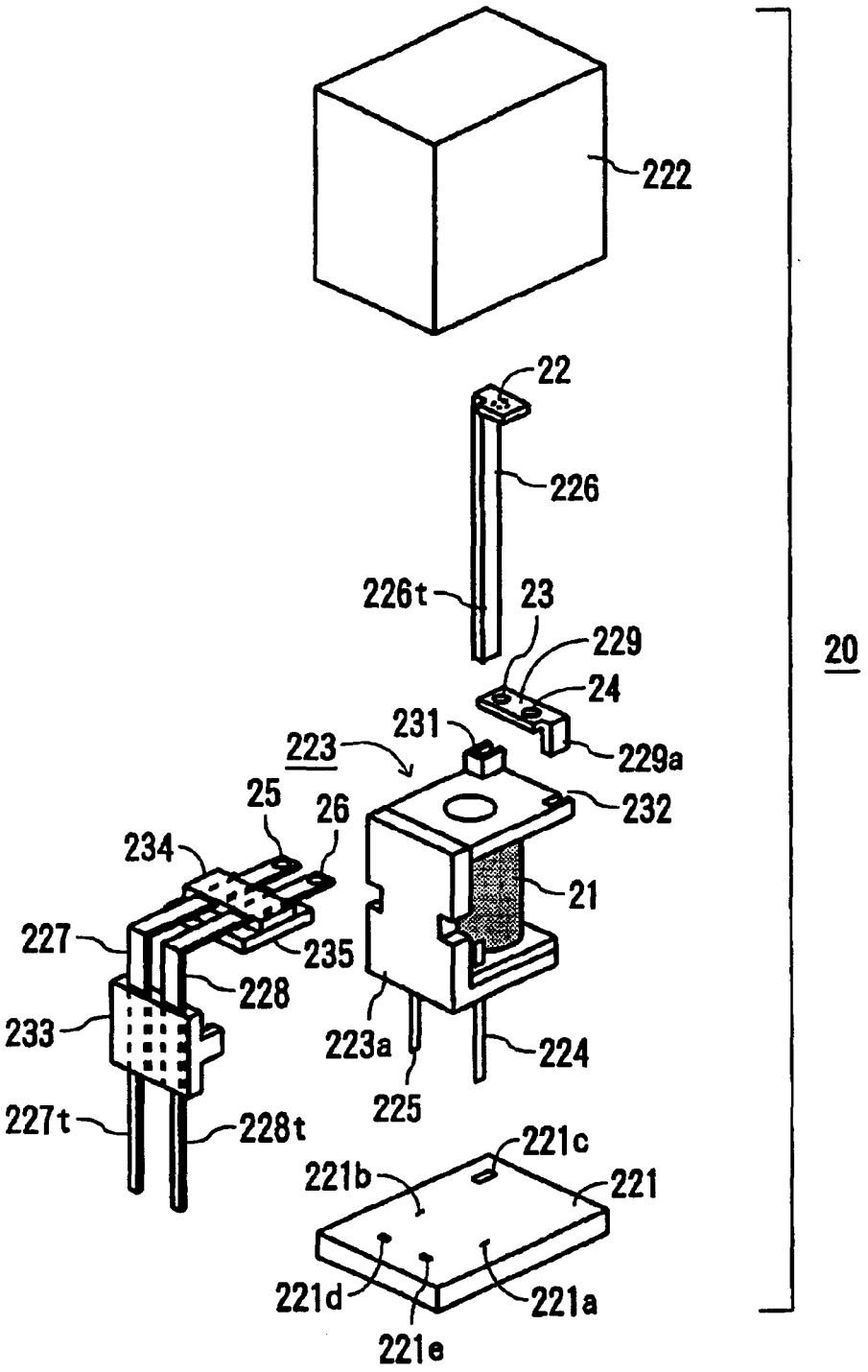
FIG. 7 is an exploded, perspective view showing another example of the structure of the electromagnetic relay shown in FIG. 3.

FIG. 7 is a perspective view showing another example of the windshield wiper drive and control electromagnetic relay 20 shown in FIG. 3, and also illustrates assemblies of the electromagnetic relay 20 in an exploded fashion. In FIG. 7, elements and parts identical to those of FIG. 4 are denoted with identical reference numerals.

As shown in FIG. 7, assemblies of the electromagnetic relay 20 are assembled on a terminal board 221. The assembled parts are covered with a cover 222 when the cover 222 is joined to the terminal board 221. According to this embodiment, the housing of the electromagnetic relay 20 is comprised of the terminal board 221 and the cover 222.

As shown in FIG. 7, an electromagnet assembly 223 is arranged such that the coil 21 with the iron-core is supported by an L-like yoke 223*a*. This electromagnet assembly 223 includes coil terminals 224, 225 made of a conductive material to which one and the other end of the coil 21 are connected, respectively. The coil terminals 224, 225 are extended through the terminal board 221 from through-holes 221*a*, 221*b* out to the outside of the housing of the electromagnetic relay 20.

A common normally open contact plate 229 is made of a conductive material. The first normally open contact 23 of the first contact group 27 and the normally open contact 24 of the second contact group 28 are formed on the common normally open contact plate 229. The common normally open contact plate 229 has a folded strip 229*a*. This folded strip 229*a* is fitted into a concave groove 232 formed on the electromagnet assembly 223, whereby the common normally open contact plate 229 is attached to the electromagnet assembly 223. No terminal is led out from the common normally open contact plate 229 to the outside of the housing of the electromagnetic relay 20.

A normally closed contact plate 226 is a contact plate made of a conductive material, and the normally closed contact 22 is formed on the normally closed contact plate 226. In this embodiment, this normally closed contact plate 226 is fitted into an insertion groove 231 formed on the electromagnet assembly 223 and thereby attached to the electromagnet assembly 223. In that case, the normally closed contact plate 226 is attached to the electromagnet assembly 223 in such a manner that the normally closed contact 22 and the normally open contact 23 on the common normally open contact plate 229 may be spaced apart from each other with a predetermined contact gap length.

A normally closed contact terminal 226*t* is integrally formed with the normally closed contact plate 226. The normally closed contact terminal 226*t* is extended though the terminal board 221 from a through-hole 221*c* to the outside of the housing of the electromagnetic relay 20.

Movable contact springs 227, 228 are each made of a conductive material. The movable contact 25 is formed on the movable contact spring 227, and the movable contact 26 is formed on the movable contact spring 228. In this embodiment, these movable contact springs 227, 228 are fixed by insulators and mounted on an armature plate 235 made of a magnetic material to produce an armature assembly.

Specifically, according to this embodiment, the two movable contact springs 227, 228 are each shaped as almost L-letter. While the movable contact springs 227, 228 are being laid side by side, the two movable contact springs 227, 228 are fixed by insulators 233, 234 at their respective sides across the position at which they are bent like an L-letter shape. The two movable contact springs 227, 228 are fixed according to insert molding using an insulating resin as the insulators 233, 234, for example.

The armature plate 235 made of a magnetic material is fixed to the insulator 234 located in the movable contact springs 227, 228 at which the movable contacts 25, 26 are provided, thereby resulting in the an nature assembly being completed.

The armature assembly including the movable contact springs 227, 228 are attached to the electromagnet assembly 223 at the portion of the insulator 233. When the coil 21 is not energized, the movable contact 25 on the movable contact spring 227 is brought in contact with the normally closed contact 22 and is also spaced apart from the normally open contact 23 with a predetermined contact gap length, the movable contact 26 on the movable contact spring 228 being spaced apart from the normally open contact 24 with a predetermined contact gap length.

In the state in which the armature assembly is attached to the electromagnet assembly 223, the armature plate 235 is attracted by a magnetic attraction from an electromagnet created when the coil 21 of the electromagnet assembly 223 is energized. Since the armature plate 235 is fixed to the two movable contact springs 227, 228, the two movable contact springs 227, 228 are simultaneously operated as the armature plate 235 is moved.

A movable contact terminal 227*t* of the movable contact spring 227 is extended through the terminal board 221 from a through-hole 221*d* to the outside of the housing of the electromagnetic relay 20. A movable contact terminal 228*t* of the movable contact spring 228 is extended through the terminal board 221 from a through-hole 221*e* to the outside of the housing of the electromagnetic relay 20.

With the above arrangement of the electromagnetic relay 20, according to the second embodiment of the present invention, in the state in which the coil 21 is not energized, the armature plate 235 is not attracted toward the electromagnet assembly 223. As a consequence, the movable contact springs 227, 228 are not displaced toward the common normally open contact plate 229 and the movable contact 25 of the first contact group 27 is separated from the normally open contact 23 and connected to the normally closed contact 22, and the movable contact 26 of the second contact group 28 is separated from the normally open contact 24.

When the coil 21 is energized through the coil terminals 224 and 225, since the armature plate 235 is attracted by the electromagnet assembly 223, the movable contact springs 227, 228 are simultaneously displaced toward the normally open contact plate 229, whereby the movable contacts 25, 26 are respectively connected to the normally open contacts 23, 24 at the same time.

Therefore, the two normally open contacts 23, 24 can be connected in series between the movable contact terminal 227*t* of the movable contact spring 227 and the movable contact terminal 228*t* of the movable contact spring 228.

When the coil 21 is not energized by current, since a magnetic attraction exerted upon the armature plate 235 from the electromagnet assembly 223 is withdrawn, the movable contact springs 227, 228 are returned to the original state in which the movable contact springs 227, 228 separate from the normally open contacts 23, 24 of the common normally open contact plate 229 nearly simultaneously by their own spring force, the movable contact 25 of the first contact group 27 is connected to the normally closed contact 22 and the movable contact 26 of the second contact group 28 separates from the normally open contact 24.

When the electromagnetic relay 20 is connected in the same way as the DC motor drive circuit is connected as shown in FIG. 3, the equivalent length of the contact gap to which the power supply voltage is applied becomes equal to the sum of the contact gap length g1 between the movable contact 25 and the normally open contact 23 of the first contact group 27 and the contact gap length g2 between the movable contact 26 and the normally open contact 24 of the second contact group 28 so that the voltage at the power supply may be divided by the respective contact gap lengths g1, g2 and applied to the contact gaps. Therefore, the contact gap lengths g1, g2, which can demonstrate the satisfactory arc cut-off capability, can be reduced as compared with the case in which the voltage at the power supply is applied to one contact gap.

According to this embodiment, since the contact gap length required by the electromagnetic relay 20 is the gap length g1 (or the gap length g2 where the gap lengths g1 and g2 are nearly equal), the contact gap length of one contact group can decrease to nearly ½ so that the electromagnetic relay 20 can be made small in size.

Since the electromagnetic relay 20 according to the second embodiment does not use the aforementioned armature card-like portion, the assemblies of the electromagnetic relay can decrease as compared with the aforementioned electromagnetic relay of the first embodiment.

With the arrangement of the second embodiment, since the two movable contact springs 227, 228 are fixed to the armature plate 235 by the insulators 233, 234, when one of the two movable contacts 25, 26 and one of the normally open contacts 23, 24 are joined by fusion welding, the other of the two movable contacts 25, 26 also cannot be returned to the release position. As a consequence, even when the movable contact 26 to which there is not the normally closed contact being connected and the normally open contact 24 are connected by fusion welding, the other movable contact 25 is not returned to the normally closed contact 22 so that a dead short can be prevented from occurring between the normally open contact and the normally closed contact due to a continuing arc occurring when the movable contact of the electromagnetic relay separates from the normally open contact.

Therefore, even when the above fusion welding occurs, only the electromagnetic relay will be destroyed in worst cases and some circuit elements such as a control circuit mounted on the same printed circuit board can be avoided from being destroyed.

Figure 8:
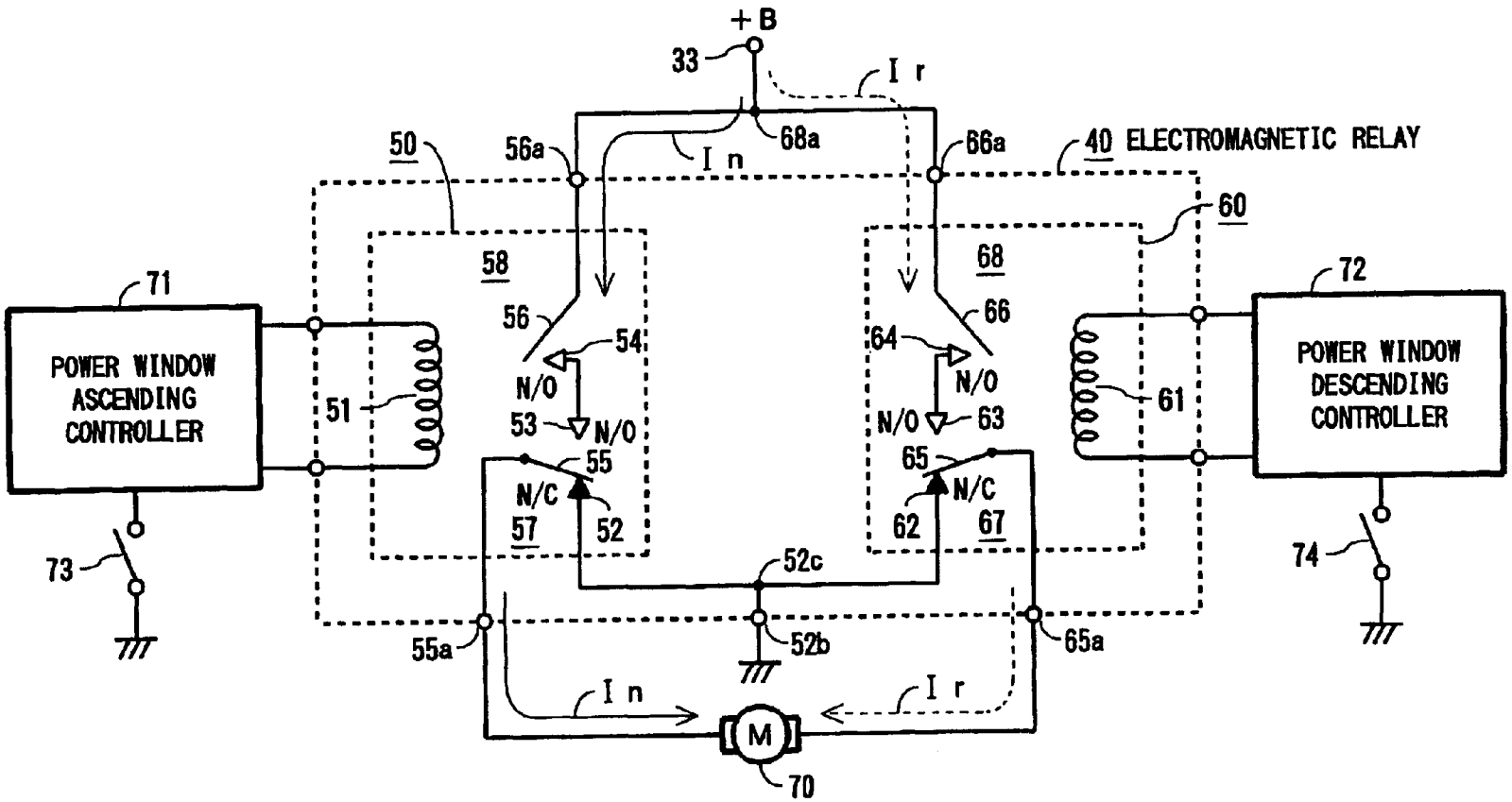
FIG. 8 is a schematic circuit diagram showing an electromagnetic relay and a DC motor drive circuit according to other embodiment of the present invention.

FIG. 8 shows an equivalent circuit of an electromagnetic relay used when the present invention is applied to the power window drive section and a DC motor drive circuit of the power window drive section using such electromagnetic relay according to other embodiment of the present invention.

According to this embodiment, as shown in FIG. 8, a single electromagnetic relay 40 for moving a power window upward and downward is driven under control of a window ascending controller 71 and a window descending controller 72. Therefore, a power window drive DC motor 70 can be driven in the positive and opposite directions or can be braked.

As shown in FIG. 8, the electromagnetic relay 40 according to this embodiment comprises first and second relay sections 50, 60 which are arranged similarly to the aforementioned electromagnetic relay 20 for driving and controlling the windshield wiper of automobile.

The first relay section 50 in the electromagnetic relay 40 comprises a coil 51, a normally closed contact 52, two normally open contacts 53, 54 and two movable contacts 55, 56. The normally closed contact 52, the normally open contact 53 and the movable contact 55 constitutes a first contact group 57. The normally open contact 54 and the movable contact 56 constitutes a second contact group 58. The two normally open contacts 53, 54 are connected in series. The two movable contacts 55, 56 are driven simultaneously by the coil 51 in unison with each other.

While the two normally open contacts 53, 54 are connected in series by connecting terminals led out from the two normally open contacts 53, 54 in the outside of the housing of the electromagnetic relay 40, in the electromagnetic relay 40 according to this embodiment, no external terminals are led out from the two normally open contacts 53, 54 but instead, the two normally open contacts 53, 54 are connected in series within the housing of the electromagnetic relay 40.

The second relay section 60 in the electromagnetic relay 40 comprises a coil 61, a normally closed contact 62, two normally open contacts 63, 64 and two movable contacts 65, 66. The normally closed contact 62, the normally open contact 63 and the movable contact 65 constitutes a first contact group 67, and the normally open contact 64 and the movable contact 66 constitutes a second contact group 68. The two normally open contacts 63, 64 are connected in series. The two movable contacts 65, 66 are simultaneously operated by the coil 61 in unison with each other.

While the two normally open contacts 63, 64 are connected in series by connecting terminals led out from the two normally open contacts 63, 64 in the outside of the housing of the electromagnetic relay 40, in the electromagnetic re lay 40 according to this embodiment, no external terminals are led out from the two normally open contacts 63, 64 but instead, the two normally open contacts 63, 64 are connected in series within the housing of the electromagnetic relay 40.

Further, in the embodiment shown in FIG. 8, the normally closed contact 52 of the first relay section 50 and the normally closed contact 62 of the second relay section 60 are connected together within the housing of the electromagnetic relay 40. One common terminal **52*b* is led out from the two normally closed contacts 52, 62 to the outside of the housing of the electromagnetic relay 40**.

One end of a power window drive DC motor 70 is connected to a movable contact terminal **55*a* connected to the movable contact 55 of the first contact group 57 in the first relay section 50, which serves to move the power window upward, of the electromagnetic relay 40. The other end of the DC motor 70 is connected to a movable contact terminal 65*a* connected to the movable contact 65 of the second relay section 60, which serves to move the power window downward, of the electromagnetic relay 40**.

The normally closed contact 52 of the first contact group 57 in the first relay section 50 and the normally closed contact 62 of the first contact group 67 in the second relay section 60 are connected to each other within the housing of the electromagnetic relay 40. A common normally closed contact terminal **52*b* is led out from a connection point 52*c* between the normally closed contacts 52 and 62. The common normally closed contact terminal 52*b*** is connected to one power supply terminal, i.e. the ground.

The normally open contact 53 of the first contact group 57 in the first relay section 50 is connected in series to the normally open contact 54 of the second contact group 58. The normally open contact terminal 63 of the first contact group 67 in the second relay section 60 is connected in series to the normally open contact terminal 64 of the second contact group 68.

The movable contact terminal **56*a* connected to the movable contact 56 of the second contact group 58 in the first relay section 50 and the movable contact terminal 66*a* connected to the movable contact 66 of the second contact group 68 in the second relay section 60 are connected to each other. A connection point 68*a* between the movable contact terminals 56*a* and 66*a* is connected to the power supply at the terminal 33**, at which a positive DC voltage (+B) of 24V, for example, is connected from the car battery.

When a user operates the power window drive section to move the power window upward, the coil 51 of the first relay section 50 is energized by a control current responsive to such user's operation under control of the power window ascending controller 71. On the other hand, when the user operates the power window drive section to move the power window downward, the coil 61 of the second relay section 60 is energized by a control current responsive to such user's operation under control of the power window descending controller 72.

Operation of the DC motor drive circuit shown in FIG. 8 Will be described below.

While the user is operating the power window drive section to move the power window upward, a switch 73 is activated to permit the coil 51 of the first relay section 50 in the electromagnetic relay 40 to be energized under control of the power window ascending controller 71. Therefore, the movable contacts 55, 56 of the first and second contact groups 57, 58 of the first relay section 50 are respectively connected to the normally open contacts 53, 54 nearly simultaneously in unison with each other. Therefore, the DC motor 70 can be activated by direct current In flowing in the direction shown by a solid-line arrow In in FIG. 8 and thereby the DC motor 70 can be driven in the positive direction. Thus, the power window of the automobile can be moved upward.

When the user stops operating the power window drive section to move the power window upward, the switch 73 is returned to the OFF position to permit the coil 51 of the first relay section 50 to be de-energized. Therefore, the movable contacts 55, 56 of the two contact groups 57, 58 are respectively separated from the normally open contacts 53, 54 in unison with each other and thereby returned to the original state nearly at the same time. As a consequence, the DC motor 70 can be braked and therefore the ascending movement of the power window of the automobile can be stopped.

While the user is operating the power window drive section to move the power window downward, a switch 74 is activated to permit the coil 61 of the second relay section 60 to be energized under control of the power window descending controller 72. Therefore, the movable contacts 65, 66 of the two contact groups 67, 68 of the second relay section 60 are respectively connected to the normally open contacts 63, 64 nearly at the same time in unison with each other. Therefore, the DC motor 70 can be activated by a direct current flowing in the direction shown by a dashed-line arrow Ir in FIG. 8 and thereby the DC motor 70 can be driven in the opposite direction. Thus, the power window of the automobile can be moved downward.

When the user stops operating the power window drive section to move the power window downward, the switch 74 is returned to the OFF position to permit the coil 61 of the second relay section 60 to be de-energized so that the movable contacts 65, 66 of the two contact groups 67, 68 are respectively separated from the normally open contacts 63, 64 in unison with each other and thereby returned to the original state nearly at the same time. Thus, the DC motor 70 can be braked and the descending movement of the power window can be stopped.

In this embodiment in which the present invention is applied to the power window drive section, when the power window is moved upward, the normally open contact 53 of the first contact group of the first relay section 50 in the electromagnetic relay 40 is connected to the power supply terminal 33 through the normally open contact 54 of the second contact group 58. When the power window is moved downward, the normally open contact 63 of the first contact group 67 of the second relay section 60 is connected to the power supply terminal 33 through the normally open contact 64 of the second contact group.68. Specifically, in any cases, the two normally open contacts N/O are connected in series to the current passage of the direct current In or Ir which flows through the DC motor 70.

Therefore, similarly to the aforementioned embodiment, even when the contact gap length in each contact group is reduced, it is possible to obviate the disadvantage of the short-circuit caused between the normally closed contact N/C and the normally open contact N/O due to the arc.

In addition, since a plurality of normally open contacts in which the contact gap length is reduced are connected in series, as mentioned before, the separating speed of the normally open contacts from the movable contacts can increase. Further, according to the electromagnetic relay 40 of this embodiment, the power window of the automobile can be moved upward and downward under control of one electromagnetic relay of which arc cut-off capability is considerably high.

As described above, according to this embodiment, it is possible to realize the small electromagnetic relay in which the contact gap length is reduced. Furthermore, there can be realized the power window drive and control electromagnetic relay in which the arc cut-off capability can be improved.

As shown in FIG. 8, the normally open contact terminals 53, 63 of the first contact groups 57, 67 of the first and second relay sections 50, 60 in the electromagnetic relay 40 can be respectively connected to the movable contacts 56, 66 of the second contact groups 58, 68 and the normally open contacts 54, 64 of the second contact groups 58, 68 can be connected to the power supply terminal 33 with similar action and effects being achieved with respect to the arc cut-off capability. However, if the normally open contacts 53, 54 or 63, 64 of the first and second contact groups 57, 58 or 67, 68 are connected together like the embodiment shown in FIG. 8, then the assemblies of the electromagnetic relay 40 can decrease, and therefore the structure of the electromagnetic relay 40 can be simplified as will be described in the following embodiments.

Figure 9:
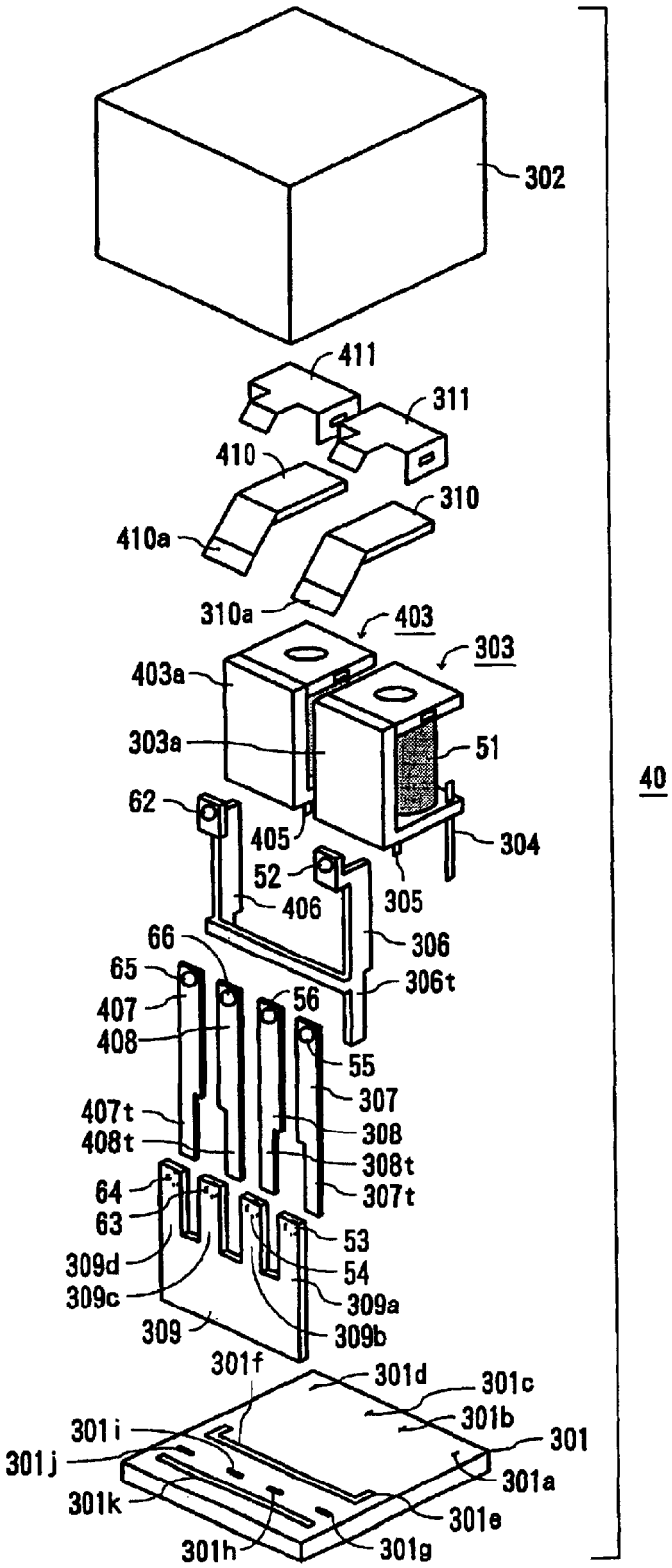
FIG. 9 is an exploded, perspective view showing an example of the structure of the electromagnetic relay shown in FIG. 8.

FIG. 9 is a perspective view showing an example of the structure of the window ascending/descending drive and control electromagnetic relay 40 shown in FIG. 8, and illustrates the electromagnetic relay 40 in an exploded fashion. In FIG. 9, elements and parts identical to those of FIG. 8 are marked with identical reference numerals.

Assemblies of the electromagnetic relay 40 in FIG. 9 are assembled on a terminal board 301. Finished assemblies are covered with a cover 302 when the cover 302 is joined to the terminal board 301. The housing of the electromagnetic relay 40 is comprised of the terminal board 301 and the cover 302.

Figure 10:
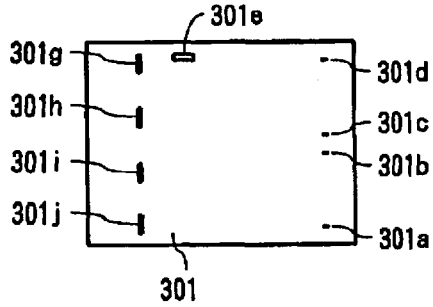
FIG. 10 is a rear view showing a part of the electromagnetic relay shown in FIG. 9.

FIG. 10 is a rear view of the terminal board 301, and illustrates through-holes 301*a*, 301*b*, 301*c*, 301*d*, 301*e*, 301*g*, 301*h*, 301*i*, 301*j* from which terminals are led out to the outside of the housing of the electromagnetic relay 40.

The example of the electromagnetic relay 40 in FIG. 9 is nearly equal to the arrangement in which the electromagnetic relay 20 shown in FIG. 4 is used as each of the first and second relay sections 50 and 60. Specifically, the electromagnetic relay 40 shown in FIG. 9 is nearly equal to the arrangement in which the two electromagnetic relays 20 shown in FIG. 4 are supported within the housing thereof.

In FIG. 9, parts denoted with reference numerals 300*s* following the reference numeral 303 identify parts in which the first relay section 50 is formed. Further, parts denoted with reference numerals 400*s* following the reference numeral 403 identify parts in which the second relay section 60 is formed.

As shown in FIG. 9, the electromagnetic relay 40 includes an electromagnet assembly 303 for use with the first electromagnetic relay section 50 and includes an electromagnet assembly 403 for use with the second electromagnetic relay section 60, respectively. The respective electromagnet assemblies 303, 403 include L-shaped yokes 303*a*, 403*a* to support coils 51, 61 with iron-cores. The electromagnet assemblies 303, 403 include coil terminals 304, 305 and 404, 405, each made of a conductive material, to which one end and the other end of the coils 51, 61 are connected, respectively. These coil terminals 304, 305, 404, 405 are extended through the terminal board 301 from the through-holes 301*a*, 301*b*, 301*c*, 301*d* to the outside of the housing of the electromagnetic relay 40.

A normally closed contact plate portion 306 is a conductive plate portion in which the normally closed contact 52 of the first contact group 57 of the first relay section 50 is formed. A normally closed contact plate portion 406 is a conductive contact plate portion in which the normally closed contact 62 of the first contact group 67 of the second relay section 60 is formed.

In this embodiment, these normally closed contact plate portions 306, 406 are integrally joined to each other, and they are also connected electrically. A normally closed contact terminal 306*t* is integrally formed with these normally closed contact plate portions 306, 406. This normally closed contact terminal 306*t* is extended the terminal board 301 from the through-hole 301*e* to the outside of the housing of the electromagnetic relay 40. A portion at which the normally closed contact plate portions 306, 406 are joined is fitted into a concave groove 301 f formed on the terminal board 301. Movable contact springs 307, 308 are made of a conductive material and are for use with the first and second contact groups 57, 58 of the first relay section 50. The movable contact 55 is formed on the movable contact spring 307, and the movable contact 56 is formed on the movable contact spring 308. In this embodiment, movable contact terminals 307*t*, 308*t* are integrally formed on these movable contact springs 307, 308, respectively. The movable contact terminal 307*t* is extended the terminal board 301 from the through-hole 301*g* to the outside of the housing of the electromagnetic relay 40. The movable contact terminal 308*t* is extended through the terminal board 301 from the through-hole 301*h* to the outside of the housing of the electromagnetic relay 40.

Movable contact springs 407, 408 are made of a conductive material and are for use with the first and second contact groups 67, 68 of the second relay section 60. The movable contact 65 is formed on the movable contact spring 407, and the movable contact 66 is formed on the movable contact spring 408. In this embodiment, movable contact terminals 407*t*, 408*t* are integrally formed on these movable contact springs 407, 408. The movable contact terminal 407*t* is extended through the terminal board 301 from the through-hole 301*i* to the outside of the housing of the electromagnetic relay 40. The movable contact terminal 408*t* is extended through the terminal board 301 from the through-hole 301*j* to the outside of the housing of the electromagnetic relay 40.

A common normally open contact plate 309 is a contact plate made of a conductive material. This common normally open contact plate 309 is made common to the first and second relay sections 50 and 60.

More specifically, as shown in FIG. 9, this common normally open contact plate 309 is comprised of a normally open contact portion 309*a* with the normally open contact 53 of the first contact group 57 of the first relay section 50 formed thereon, a normally open contact portion 309*b* with the normally open contact 54 of the second contact group 58 formed thereon, a normally open contact portion 309*c* with the normally open contact 63 of the first contact group 67 of the second relay section 60 formed thereon and a normally open contact portion 309*d* with the normally open contact 64 of the second contact group 68 formed thereon.

Specifically, the normally open contacts 53, 54 of the first and second contact groups 57, 58 of the first relay section 50 and the normally open contacts 63, 64 of the first and second contact groups 67, 68 of the second relay section 60 are formed on the common normally open contact plate 309 arranged as a single common conductive plate portion. Therefore, the normally open contacts 53, 54, 63, 64 are electrically connected in common.

Although this common normally open contact plate 309 is fitted into a concave groove 301*k* formed on the terminal board 301, no terminal is led out from the common normally open contact plate 309 to the outside of the housing of the electromagnetic relay 40.

In the first relay section 50, the armature 310 made of a magnetic material is attached to the electromagnet assembly 303 by a hinge spring 311. In this embodiment, this armature 310 includes an armature card-like portion 310*a*. If the armature 310 is attracted toward the electromagnet assembly 303 by a magnetic attraction from an electromagnet created when the coil 51 is energized, then the armature card-like portion 301*a* can simultaneously displace the two movable contact springs 307, 308 toward the common normally open contact plate 309 as shown by an arrow B1 in FIG. 11.

In the first relay section 60, an armature 410 made of a magnetic material is attached to an electromagnet assembly 403 by a hinge spring 411. In this embodiment, this armature 410 includes an armature card-like portion 410*a*. If the armature 410 is attracted toward the electromagnet assembly 303 by a magnetic attraction from an electromagnet created when the coil 61 is energized, then the armature card-like portion 410*a* can simultaneously displace the two movable contact springs 407, 408 toward the common normally open contact plate 309 as shown by an arrow C1 in FIG. 11.

With the above arrangement of the electromagnetic relay 40, in the first relay section 50, under the condition that the coil 51 is not energized, the armature 310 is not attracted toward the electromagnet assembly 303 by a magnetic attraction so that the movable contact springs 307 and 308 are not displaced toward the common normally open contact plate 309. As a consequence, the normally closed contact 52 of the first contact group 57 and the movable contact 55 are connected to each other, and the movable contact 56 of the second contact group 58 is separated from the normally open contact 54.

Figure 11:
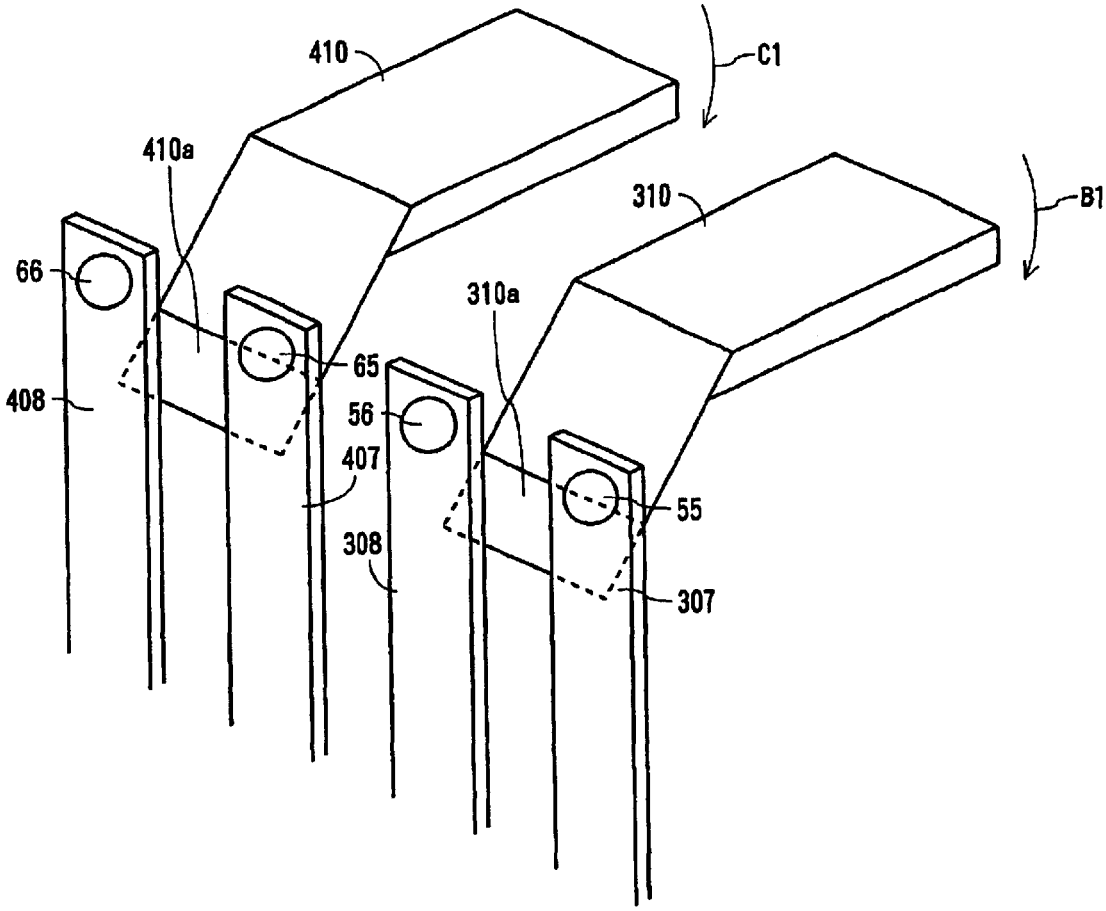
FIG. 11 is a fragmentary, perspective view to which reference will be made in explaining operation of the electromagnetic relay shown in FIG. 9.

When the coil 51 is energized through the coil terminals 304 and 305, the armature 310 is attracted toward the electromagnet assembly 303 by a magnetic attraction and the armature card-like portion 310*a* at the tip of this armature 310 displaces the two movable contact springs 307, 308 toward the common normally open contact plate 309 at the same time as shown by the arrow B1 in FIG. 11.

Since the movable contact spring 307 is resiliently displaced by the armature 310 at that very moment, the movable contact 55 of the first contact group 57 is separated from the normally closed contact 52 and connected to the normally open contact 53 of the normally open contact portion 309*a* of the common normally open contact plate 309. Further, since the movable contact spring 308 is resiliently displaced by the armature 310, the movable contact 56 of the second contact group 58 is connected to the normally open contact 54 of the normally open contact portion 309*b* of the common normally open contact plate 309.

Therefore, two normally open contacts can be connected in series between the movable contact terminal 307*t* of the movable contact spring 307 and the movable contact terminal 308*t* of the movable contact spring 308.

When the coil 51 is not energized, a magnetic attraction exerted upon the armature 310 by the electromagnet assembly 303 is withdrawn so that the resilient displacement force exerted upon the movable spring contacts 307, 308 by the armature 310 also is withdrawn. As a result, the movable contact springs 307, 308 separate from the normally open contacts 53, 54 of the common normally open contact plate 309 nearly at the same time by their own spring force and are returned to the original state in which the movable contact 55 of the first contact group 57 is connected to the normally closed contact 52 and the movable contact 56 of the second contact group 58 is separated from the normally open contact 54.

The second relay section 60 also can be operated in the same way as the first relay section 50 is operated as described above.

In the electromagnetic relay 40 according to this embodiment, since the first and second relay sections 50, 60 can achieve the same action and effects as those of the aforementioned electromagnetic relay 20 shown in FIG. 4, this electromagnetic relay 40 can achieve similar effects to those of the electromagnetic relay 20 of the aforementioned embodiment shown in FIG. 4. Specifically, according to this embodiment, even when the contact gap length is reduced, it is possible to realize the window ascending/descending drive and control electromagnetic relay which is excellent in arc cut-off capability.

In the case of the electromagnetic relay 40 according to this embodiment, since all normally open contacts 53, 54, 63, 64 of the first and second relay sections 50, 60 are formed on the common normally open contact plate 309, the assemblies of the electromagnetic relay 40 can decrease much more, and the structure of the electromagnetic relay 40 can be simplified. Moreover, the electromagnetic relay 40 according to this embodiment can omit the electrical connection process for electrically connecting a plurality of normally open contacts in series.

Further, according to the electromagnetic relay 40 of this embodiment shown in FIG. 9, since the two movable contact springs 307, 308 and 407, 408 are resiliently displaced nearly at the same time by the armatures 310, 410 of the first and second relay sections 50, 60, each of the first and second relay sections 50, 60 requires only one coil. Moreover, the electromagnetic relay according to this embodiment can easily satisfy the aforementioned condition the movable contacts should be separated from the two normally open contacts nearly at the same time which is necessary for improving the arc cut-off capability.

Furthermore, according to the embodiment shown in FIG. 9, since the normally closed contacts 52, 62 of the first and second relay sections 50, 60 are connected to each other within the housing of the electromagnetic relay 40 to provide the common normally closed contact assembly and the terminal 306*t* is led out from this common normally closed contact assembly, the terminals can decrease, and the assemblies also can decrease.

In a like manner, the movable contact spring 308 with the movable contact 56 of the second contact group 58 of the first relay section 50 disposed thereon and the movable contact spring 408 with the movable contact 66 of the second contact group 68 of the second relay section 60 disposed thereon are connected to each other within the housing of the electromagnetic relay 40 so as to produce one assembly and one terminal is led out from this common assembly.

Figure 12:
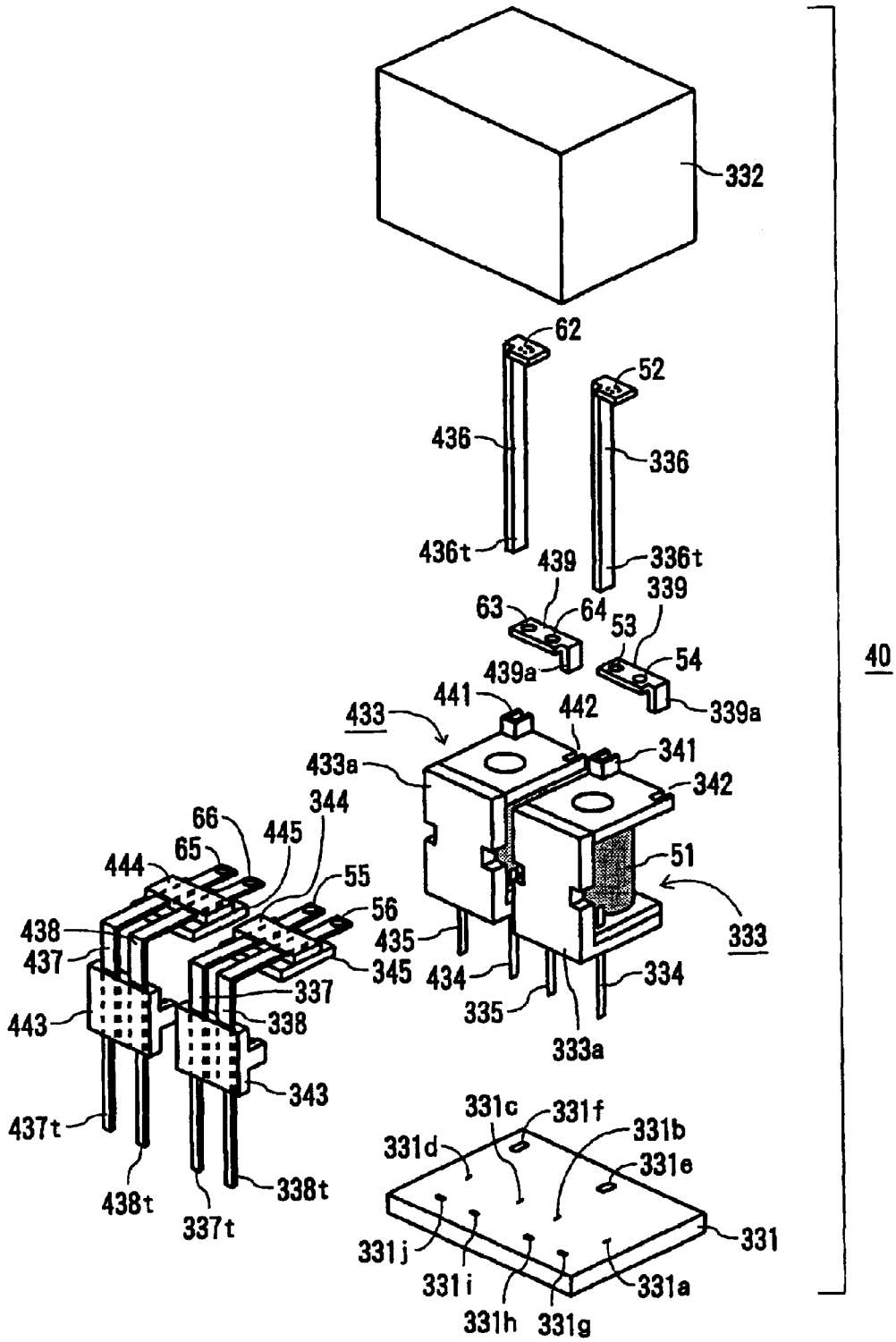
FIG. 12 is an exploded, perspective view showing other example of the structure of the electromagnetic relay shown in FIG. 8.

FIG. 12 is a perspective view showing other example of the structure of the window ascending/descending drive and control electromagnetic relay 40 shown in FIG. 8. FIG. 12 also illustrates the assemblies of the electromagnetic relay 40 in an exploded fashion. In FIG. 12, elements and part identical to those of FIG. 8 are marked with identical reference numerals.

Respective assemblies of the electromagnetic relay 40 shown in FIG. 12 are assembled on a terminal board 331. Finished assemblies are covered with a cover 332 when the cover 332 is joined with the terminal board 331. The housing of the electromagnetic relay 40 is comprised of the terminal board 331 and the cover 332. The terminal board 331 includes through-holes 331*a*, 331*b*, 331*c*, 331*d*, 331*e*, 331*g*, 331*h*, 331*i*, 331*j* through which terminal are led out to the outside of the housing of the electromagnetic relay 40.

The example of the electromagnetic relay 40 shown in FIG. 12 is nearly equal to the arrangement in which the electromagnetic relay 20 shown in FIG. 7 is used as each of the first and second relay sections 50, 60. Specifically, the electromagnetic relay 40 shown in FIG. 12 is nearly equal to the arrangement in which the two electromagnetic relay 20 shown in FIG. 7 are retained within the housing thereof.

In FIG. 12, elements and parts denoted by reference numerals 300*s* following reference numeral 333 are those in which the first relay section 50 is formed. Elements and parts denoted by reference numerals 400*s* following reference numeral 433 are those in which the second relay section 60 is formed.

As shown in FIG. 12, the electromagnetic relay 40 includes an electromagnet assembly 333 for use with the first relay section 50 and also includes an electromagnet assembly 433 for use with the second relay section 60. The electromagnet assemblies 333, 433 includes L-shaped yokes 333*a*, 433*a* to support coils 51 and 61 with iron-cores. The electromagnet assemblies 333, 433 include coil terminals 334, 335 and 434, 435, each made of a conductive material, to which one and the other end of the coils 51, 61 are connected, respectively. These coil terminals 334, 335, 434, 435 are extended through the terminal board 331 from the through-holes 331*a*, 331*b*, 331*c*, 331*d* to the outside of the housing of the electromagnetic relay 40.

A common normally open contact plate 339 includes the normally open contact 53 of the first contact group 57 of the first relay section 50 and the normally open contact 54 of the second contact group 58 commonly formed thereon. A common normally open contact plate 439 includes the normally open contact plate 63 of the first contact group 67 of the second relay section 60 and the normally open contact 64 of the second contact group 68 commonly formed thereon.

These common normally open contact plates 339, 439 include folded strips 339*a*, 439*a*, respectively. When the folded strips 339*a*, 439*a* are fitted into concave grooves 342, 442 formed on the electromagnet assemblies 333, 433, the common normally open contact plates 339, 439 may be attached to the electromagnet assemblies 333, 433. No terminal is led out from these common normally open contact plates 339, 439 to the outside of the housing of the electromagnetic relay 40.

A normally closed contact plate 336 is a conductive contact plate with the normally closed contact 52 of the first contact group 57 of the first relay section 50 formed thereon. A normally closed contact plate 436 is a conductive contact plate with the normally closed contact 62 of the first contact group 67 of the second relay section 60 formed thereon.

In this embodiment, normally closed contact terminals 336*t*, 436*t* are integrally formed with these normally closed contact plates 336, 436, respectively. These normally closed contact terminals 336*t*, 436*t* are extended through the terminal board 331 from the through-holes 331*e*, 331*f* to the outside of the housing of the electromagnetic relay 40.

In this embodiment, the normally closed contact plates 336, 436 are fitted into insertion grooves 341, 441 formed in the electromagnet assemblies 333, 433 and thereby attached to the electromagnet assemblies 333, 433, respectively. The normally closed contact plate 336 is attached to the electromagnet assembly 333 in such a fashion that the normally closed contact 52 and the normally open contact 53 on the common normally open contact plate 339 are spaced apart from each other with a predetermined contact gap length. Similarly, the normally closed contact plate 436 also is attached to the electromagnet assembly 433 in such a fashion that the normally closed contact 62 and the normally open contact 63 on the common normally open contact plate 439 are spaced apart from each other with a predetermined contact gap length. Heights of the insertion grooves 341, 441 are equal to a distance between the normally open contact 53 and the normally closed contact 53 and a distance between the normally open contact 63 and the normally closed contact 62, respectively.

First and second movable contact springs 337, 338 are made of a conductive material and are for use with the first and second contact groups 57, 58 of the first relay-section 50. The movable contact 55 is formed on the movable contact spring 337, and the movable contact 56 is formed on the movable contact spring 338. In this embodiment, these movable contact springs 337, 338 are fixed by insulators, which will be described later on, and attached to an armature plate 345, thereby resulting in the armature assembly of the first relay section 50 being completed.

Movable contact springs 437, 438 are made of a conductive material and are for use with the first and second contact groups 67, 68 of the second relay section 60. The movable contact 65 is formed on the movable contact spring 437, and the movable contact 66 is formed on the movable contact spring 438. In this embodiment, these movable contact springs 437, 438 are fixed by insulators, which will be described later on, and attached to an armature plate 445, thereby resulting in the armature assembly of the second relay section 60 being completed.

Specifically, the movable contact springs 337, 338, 437 and 438 are each shaped as nearly L-letter. As shown in FIG. 12, while being laid side by side, the movable contact springs 337, 338 and the movable contact springs 437, 438 are fixed by insulators 343, 344 and 443, 444 at their respective sides of the position at which they are bent like L-shape. The movable contact springs 337, 338 and 437, 438 may be fixed according to insert molding using an insulating resin as the insulators 343, 344 and 443, 444, for example.

The armature plates 345, 445, each made of a magnetic material, are respectively fixed to the insulators 344 and 444 and thereby the armature assemblies of the first and second relay sections 50, 60 can be completed.

The armature assemblies of the first and second relay sections 50, 60 are attached to the electromagnet assemblies 333, 433 at the portions of the insulators 343, 443, respectively. In the state in which the coil 51 is not energized, the movable contacts 55, 56 on the movable contact springs 337, 437 are brought in contact with the normally closed contacts 52, 62 and are also spaced apart from the normally open contacts 53, 63 with a predetermined contact gap length. The movable contacts 56, 66 on the movable contact springs 338, 438 are spaced apart from the normally open contacts 54, 64 with a predetermined contact gap length.

In the state in which the armature assemblies are respectively attached to the electromagnet assemblies 333, 433, the armature plates 345, 445 are attracted by a magnetic attraction from electromagnets created when the coils 51, 61 of the electromagnet assemblies 333, 433 are energized. Since the armature plates 345, 445 are respectively fixed to the two movable contact springs 337, 338 and 437, 438, the two movable contact springs 337, 338 and 437, 438 may be respectively operated in accordance with the movements of the armature plates 345, 445.

The respective movable contact terminals 337*t*, 338*t*, 437*t* and 438*t* of the movable contact spring 337 are extended through the terminal board 331 from the through-holes 331*g*, 331*h*, 331*i* and 331*j* to the outside of the housing of the electromagnetic relay 40.

With the above arrangement of the electromagnetic relay 40 according to this embodiment, the first and second relay sections 50, 60 can be operated similarly to the aforementioned electromagnetic relay 20 according to the embodiment shown in FIG. 7.

As described above, in the electromagnetic relay 40 according to this embodiment, the first and second relay sections 50, 60 can achieve the same action and effects as those of the aforementioned electromagnetic relay 20 shown in FIG. 7 and therefore can achieve effects similar to those of the aforementioned electromagnetic relay 20 according to the embodiment shown in FIG. 7. Thus, according to this embodiment, there can be realized the power window ascending/descending drive and control electromagnetic relay 40 in which an excellent arc cut-off capability can be obtained even though the contact gap length is reduced.

As compared with the arrangement in which the electromagnetic relay 20 according to the embodiment shown in FIG. 4 is used in the first and second relay sections 50, 60, according to the electromagnetic relay 40 of this embodiment, the assemblies of the first and second relay sections 50, 60 can decrease, and the electromagnetic relay 40 can be simplified in structure.

Furthermore, as described in the embodiment shown in FIG. 7, in the first and second relay sections 50, 60, the normally open contacts and the normally closed contacts can be protected from a dead-short caused by a continuous arc occurring when the respective movable contacts are separated from the normally open contacts. Therefore, it is possible to avoid an accident in which circuit elements such as a control circuit mounted on the same printed circuit board in which the electromagnetic relay is provided will be destroyed by the dead-short.

Figure 13:
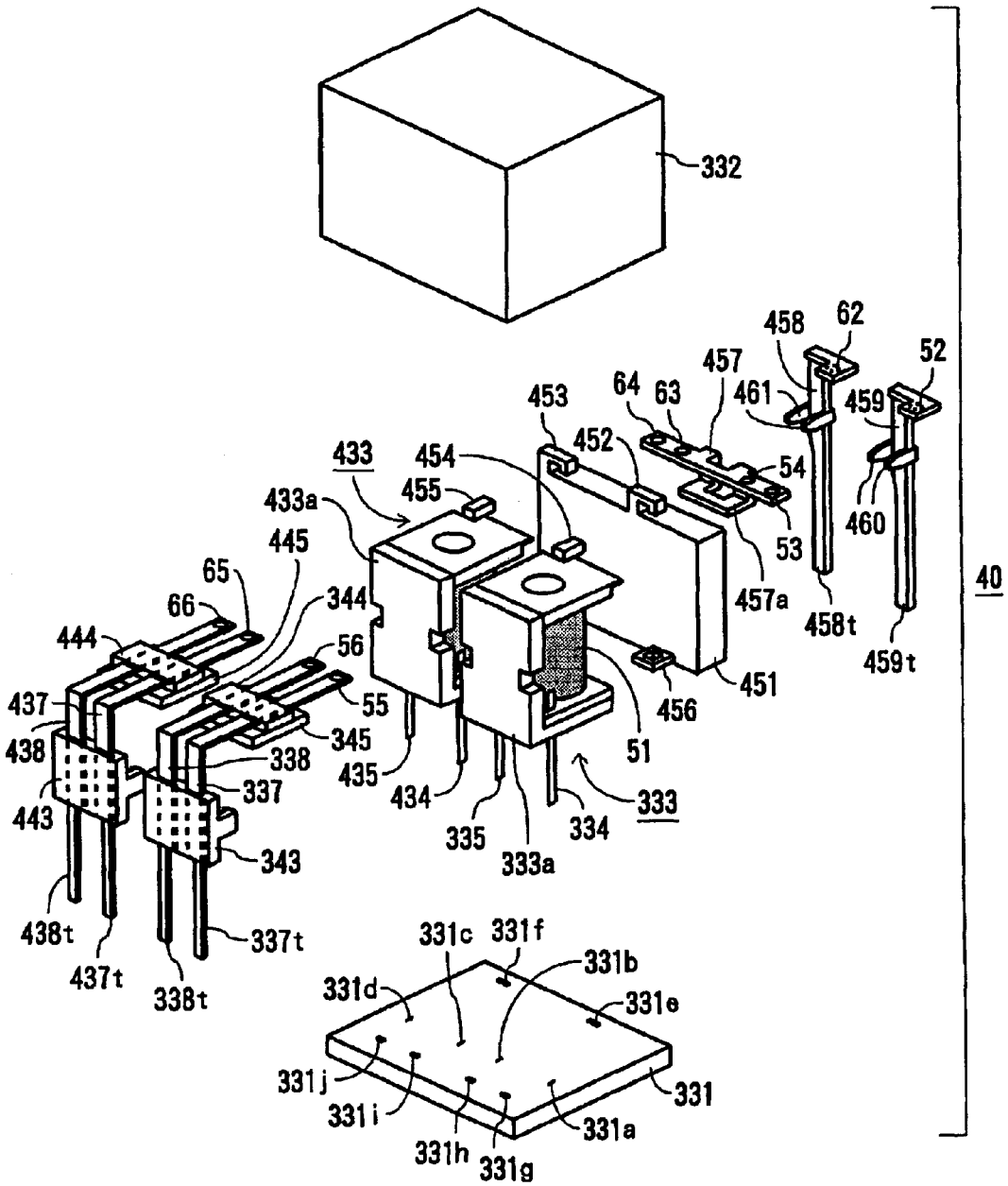
FIG. 13 is an exploded, perspective view showing a further example of the structure of the electromagnetic relay shown in FIG. 8.

FIG. 13 is a perspective view showing a further example of the structure of the power window ascending/descending drive and control electromagnetic relay 40 shown in FIG. 8. FIG. 13 also illustrates the assemblies of the electromagnetic relay 40 in an exploded fashion. In the third embodiment of the present invention shown in FIG. 13, similarly to the aforementioned second embodiment shown in FIG. 12, armature assemblies similar to that of the electromagnetic relay 20 shown in FIG. 7 are used as the first and second relay sections 50, 60. In FIG. 13, elements and parts identical to those of FIG. 12 are marked with identical reference numerals.

According to the third embodiment, as shown in FIG. 13, in particular, the normally open contacts 53, 54 of the first and second contact groups 57, 58 of the first relay section 50 and the normally open contacts 63, 64 of the first and second contact groups 67, 68 of the second relay section 60 are integrally formed on a common normally open contact plate 457 which is arranged as a single common conductive plate portion. Therefore, the normally open contacts 53, 54, 63, 64 are electrically connected in common.

According to the third embodiment, a common attachment plate 451 is used in order to commonly attach the common normally open contact plate 457 to the electromagnet assemblies 333, 433. The common attachment plate 451 includes fitting portions 452, 453. When protruded portions 454, 455, respectively provided on the electromagnet assemblies 333, 433, are respectively fitted into the fitting portions 452, 453, the common attachment plate 451 is joined to the electromagnet assemblies 333, 433.

The common attachment plate 451 includes resilient projected plates 456 (only one resilient projected plate 456 is shown in FIG. 13) formed at its positions opposing to the bottoms of the electromagnet assemblies 333, 433. When protruded portions (not shown) provided on the electromagnet assemblies 333, 433 are fitted into concave holes of the resilient projected plates 456, the common attachment plate 451 is firmly joined to the electromagnet assemblies 333, 433, respectively.

The common normally open contact plate 457 and normally closed contact plates 458, 459, which are corresponding to the normally closed contact plates 336, 436, are attached to the common attachment plate 451. Normally closed contact terminals 458*t*, 459*t* are integrally formed with these normally closed contact plates 458, 459, respectively. These normally closed contact terminals 458*t*, 459*t* are extended through the terminal board 331 from the through-holes 331*e*, 331*f* to the outside of the housing of the electromagnetic relay 40.

A concave groove (not shown) is formed on the common attachment plate 451 at its opposite surface of the surface facing to the electromagnet assemblies 333, 433. A pressure plate portion 457*a* of the common normally open contact plate 457 is fitted into the above concave groove with pressure. Moreover, concave grooves (not shown) also are formed on the common attachment plate 451 at its opposite surface of the surface opposing to the electromagnet assemblies 333, 433. Pressure protrusions 460, 461 of the normally closed contact plate portions 458, 459 are fitted into the above concave grooves with pressure.

The movable contact springs 337, 338, 437 and 438 are extended by a length equal to the common attachment plate 451 at their sides in which the movable contacts 55, 56, 65 and 66 are provided. Since the positions of the normally closed contact plate portions 458, 459 are different from those of the case of the second embodiment shown in FIG. 12, the positions of the movable contact springs 337, 338 and the positions of the movable contact springs 437, 438 become opposite to those of the case of the second embodiment shown in FIG. 12.

A rest of elements and parts of the third embodiment is formed similarly to those of the second embodiment. Hence, the electromagnetic relay 40 according to the third embodiment can be arranged.

It is needless to say that the electromagnetic relay 40 according to the third embodiment shown in FIG. 13 can achieve action and effects similar to those of the above embodiments. According to the third embodiment, the normally open contacts 53, 54 of the first and second contact groups 57, 58 of the first relay section 50 and the normally open contacts 63, 64 of the first and second contact groups 67, 68 of the second relay section 60 are formed on the common normally open contact plate 457 which is arranged as a single common conductive plate portion. Therefore, the normally open contacts 53, 54 and 63, 64 are electrically connected in common. Thus, the arrangement of the electromagnetic relay 40 according to the third embodiment can be simplified.

Figure 14:
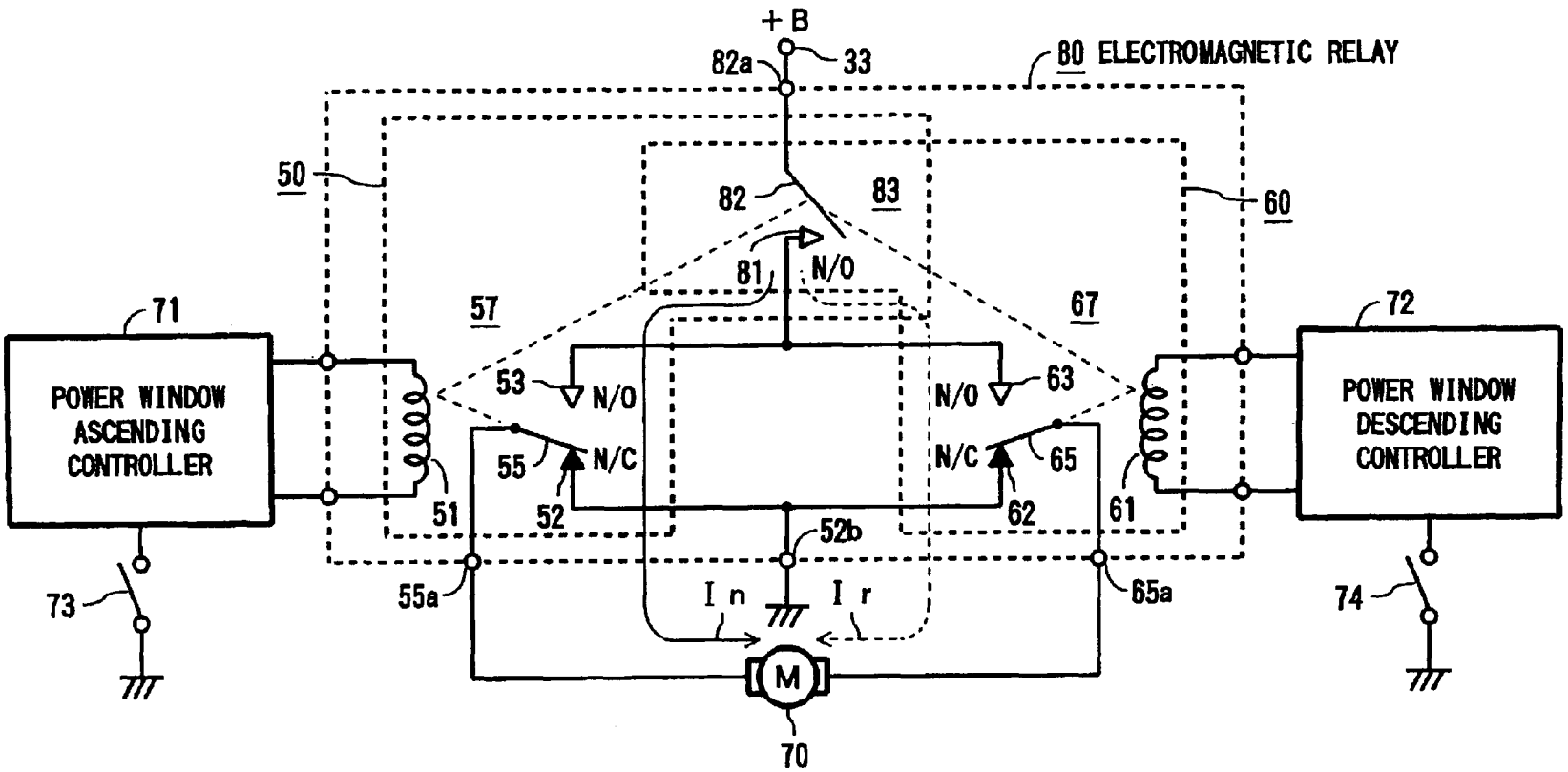
FIG. 14 is a schematic circuit diagram showing a DC motor drive circuit using an electromagnetic relay according to a further embodiment of the present invention.

FIG. 14 is a schematic circuit diagram showing an equivalent circuit of an electromagnetic relay used when the present invention is applied to a power window drive section and a DC motor drive circuit of a power window drive section using this electromagnetic relay according to a further embodiment of the present invention.

A power window ascending/descending drive and control electromagnetic relay 80 according to the embodiment shown in FIG. 14 is a modified example of the aforementioned electromagnetic relay 40 shown in FIGS. 8 and 9. Although this electromagnetic relay 80 also comprises the first relay section 50 and the second relay section 60 fundamentally, this electromagnetic relay 80 differs from the aforementioned electromagnetic relay 40 in that the second contact group 58 of the first relay section 50 and the second contact group 68 of the second relay section 60 are integrally formed as one common contact group 83.

Specifically, as shown in FIG. 14, the above-described common contact group 83 is comprised of a normally open contact 81 and a movable contact 82. The normally open contact 53 of the first contact group 57 of the first relay section 50, the normally open contact 63 of the first contact group 67 of the second relay section 60 and the normally open contact 81 of the common contact group 83 are connected in common. A movable contact terminal with the movable contact 82 of the common contact group 83 connected thereto is connected to the terminal 33 at the power supply.

The movable contact 82 of the common contact group 83 is arranged such that it can be operated by both of the coil 51 of the first relay section 50 and the coil 61 of the second relay section 60. A rest of the arrangement of the electromagnetic relay 80 is exactly the same as that of the electromagnetic relay 40 shown in FIG. 8.

An operation of the DC motor drive circuit shown in FIG. 14 and its action and effects are exactly the same as those of the DC motor drive circuit shown in FIG. 8 excepting that the operation of the common contact group 83 becomes equal to those of the second contact groups 58, 68 in the first and second relay sections 50 and 60.

Figure 15:
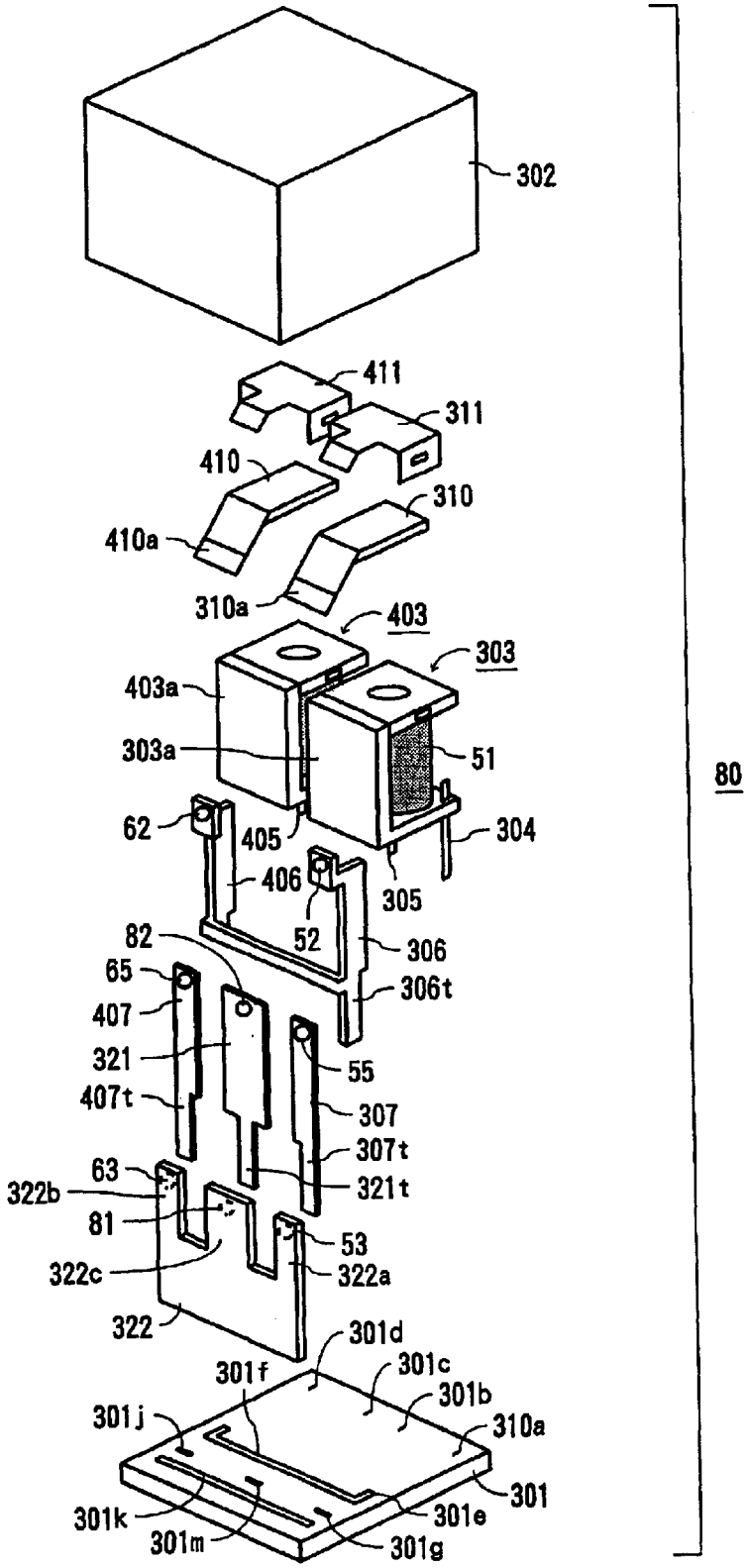
FIG. 15 is an exploded, perspective view showing an example of the structure of the electromagnetic relay shown in FIG. 14.

FIG. 15 is a perspective view showing an example of the structure of the power window ascending/descending drive and control electromagnetic relay 80 shown in FIG. 14, and illustrates the assemblies of the electromagnetic relay 80 in an exploded fashion. Since the electromagnetic relay 80 shown in FIG. 15 differs from the electromagnetic relay 40 shown in FIG. 9 only in the portion of the movable contact spring, the portion of the common normally open contact plate and the number of the through-holes on the terminal board and is exactly the same as the electromagnetic relay 40 shown in FIG. 9, elements and parts identical to those of FIG. 9 are denoted by identical reference numerals and therefore need not be described.

Figure 16:
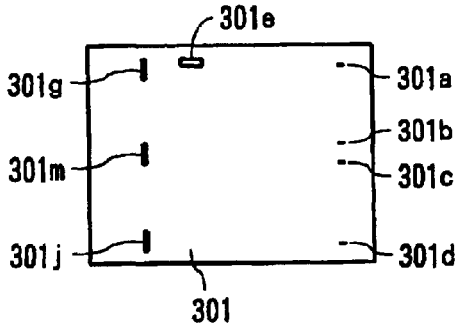
FIG. 16 is a rear view showing a part of the electromagnetic relay shown in FIG. 15.

FIG. 16 is a rear view of the terminal board 301 of this electromagnetic relay 80, and illustrates the through-holes 301*a*, 30 1*b*, 301*c*, 301*d*, 301*e*, 301*g*, 301*m*, 301*j* through which the terminals are led out to the outside of the housing of the electromagnetic relay 80. Having compared this terminal board 301 of the electromagnetic relay 80 with the terminal board 301 of the electromagnetic relay 40 shown in FIG. 8, it will be appreciated that the through-holes to lead out the terminals to the outside of the housing of the electromagnetic relay 80 decrease because one terminal led out from the movable contact spring decreases.

As shown in FIG. 15, in this electromagnetic relay 80, the movable contact spring 308 of the aforementioned first relay section 50 shown in FIG. 9 and the movable contact spring 408 of the second relay section 60 are integrally formed as a single common movable contact spring 321. The movable contact 82 of the common contact group 83 is disposed on this common movable contact spring 321. A terminal 321*t* is led out from this common movable contact spring 321 through the through-hole 301*m* of the terminal board 301 to the outside of the housing of the electromagnetic relay 80.

The electromagnetic relay 80 according to this embodiment includes a common normally open contact plate 322 which is comprised of three movable contact springs 307, 407 and 321. More specifically, the common normally open contact plate 322 is comprised of a normally open contact portion 322*a* with the normally open contact 53 of the first relay section 50 formed thereon, a normally open contact portion 322*b* with the normally open contact 63 of the second relay section 60 formed thereon and a normally open contact portion 322*c* with the normally open contact 81 of the common contact group 83 formed thereon.

This common normally open contact plate 322 is fitted into the concave groove 301*k* formed on the terminal board 301. However, no terminal is led out from this common normally open contact plate 322 to the outside of the housing of the electromagnetic relay 80. A rest of the arrangement of the electromagnetic relay 80 shown in FIGS. 15 and 16 is exactly the same as that of the electromagnetic relay 40 shown in FIG. 9.

With the above arrangement of the electromagnetic relay 80 according to this embodiment, in the first relay section 50, under the condition that the coil 51 is not energized, the armature 310 is not attracted by a magnetic attraction from the electromagnet so that the movable contact spring 307 and the common movable contact spring 321 are not displaced toward the common normally open contact plate 322. As a result, the normally closed contact 52 of the first contact group 57 and the movable contact 55 are connected to each other and the movable contact 82 of the common contact group 83 is separated from the normally open contact 81.

Figure 17:
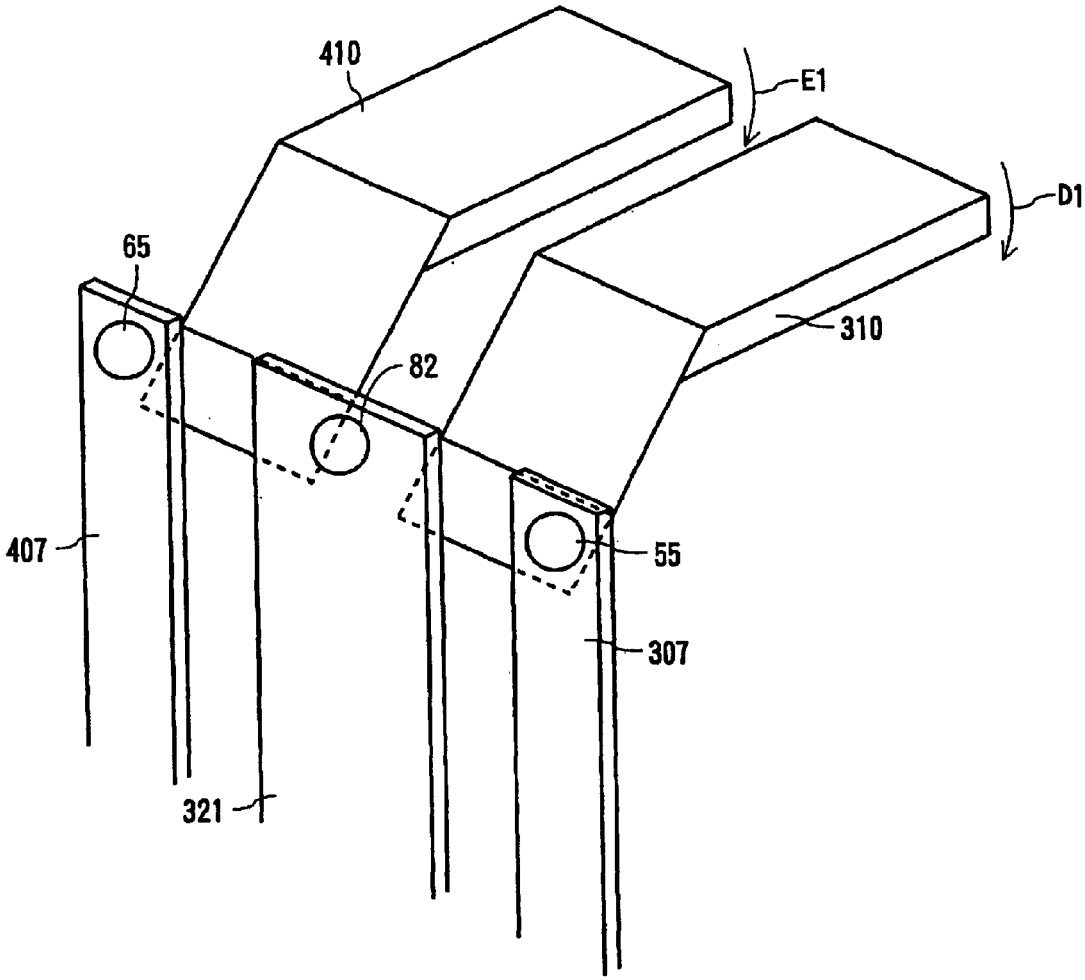
FIG. 17 is a fragmentary, perspective view to which reference will be made in explaining operation of the electromagnetic relay shown in FIG. 15.

When the coil 51 is energized through the coil terminals 304, 305, the armature 301 is attracted toward the electromagnet assembly 303 by a magnetic attraction from the created electromagnet with the result that the armature card-like portion 310*a* at the tip of this armature 310 displaces the movable contact spring 307 and the common movable contact spring 321 toward the common normally open contact plate 322 as shown by an arrow D1 in FIG. 17.

When the movable contact spring 307 is resiliently displaced by the armature 310 at that very moment, the movable contact 55 of the first contact group 57 is separated from the normally closed contact 52 and connected to the normally open contact 53 of the normally open contact portion 322*a* of the common normally open contact plate 322. When the common movable contact spring 321 is resiliently displaced by the armature 310, the movable contact 82 of the common contact group 83 is connected to the normally open contact 81 of the normally open contact portion 322*c* of the common normally open contact plate 322.

Therefore, the two normally open contacts 53, 81 can be connected in series between the movable contact terminal 307*t* of the movable contact spring 307 and the movable contact terminal 321*t* of the common movable contact spring 321.

When the coil 51 is not energized, since the resilient displacement force exerted upon the movable contact spring 307 and the common movable contact spring 321 by the armature 310 is withdrawn, the movable contact spring 307 and the common movable contact spring 321 are separated from the normally open contact 53 of the common normally open contact plate 322 and the normally open contact 81 of the common contact group 83 nearly at the same time due to their spring force and thereby returned to the original state in which the movable contact 55 of the first contact group 57 is connected to the normally closed contact 52.

In the second relay section 60, under the condition that the coil 61 is not energized, the armature 410 is not attracted by the electromagnet. As a consequence, the movable contact spring 407 and the common movable contact spring 321 are not displaced toward the common normally open contact plate 322, and the normally closed contact 62 and the movable contact 65 of the first contact group 67 are connected to each other. Concurrently therewith, the movable contact 82 of the common contact group 83 is separated from the normally open contact 81.

When the coil 61 is energized through the coil terminals 404 and 405, the armature 410 is attracted by a magnetic attraction from the electromagnet so that the armature card-like portion 410*a* at the tip of this armature 410 displaces the movable contact spring 407 and the common movable contact spring 321 toward the common normally open contact plate 322 as shown by an arrow El in FIG. 17.

Since the movable contact spring 407 is resiliently displaced by the armature 410 at that very moment, the movable contact 65 of the first contact group 67 is separated from the normally closed contact 62 and connected to the normally open contact 63 of the normally open contact portion 322*b* of the common normally open contact plate 322. Since the common movable contact spring 321 is resiliently displaced by the armature 410, the movable contact 82 of the common contact group 83 is connected to the normally open contact 81 of the normally open contact portion 322*c* of the common normally open contact plate 322.

Therefore, the two normally open contacts 63, 81 can be connected in series between the movable contact terminal 407*t* of the movable contact spring 407 and the movable contact terminal 32 it of the common movable contact spring 321.

When the coil 61 is not energized, the resilient displacement force generated by the armature 410 is withdrawn so that the movable contact spring 407 and the common movable contact spring 321 are separated from the normally open contact 63 of the common normally open contact plate 322 and the normally open contact 81 of the common contact group 83 nearly simultaneously by their own spring force and thereby returned to the original state in which the movable contact 65 of the first contact group 67 is connected to the normally closed contact 62.

The electromagnetic relay 80 according to this embodiment can achieve action and effects similar to those of the electromagnetic relay 40 of the aforementioned embodiment. Specifically, according to this embodiments there can be realized the power window ascending/descending drive and control electromagnetic relay in which the excellent arc cut-off capability can be obtained even though the contact gap length is reduced.

According to the electromagnetic relay 80 of this embodiment, as compared with the electromagnetic relay 40, one movable contact spring can be decreased by using the common movable contact spring 321. Hence, it is possible to realize the electromagnetic relay which can be more simplified in structure.

Figure 18:
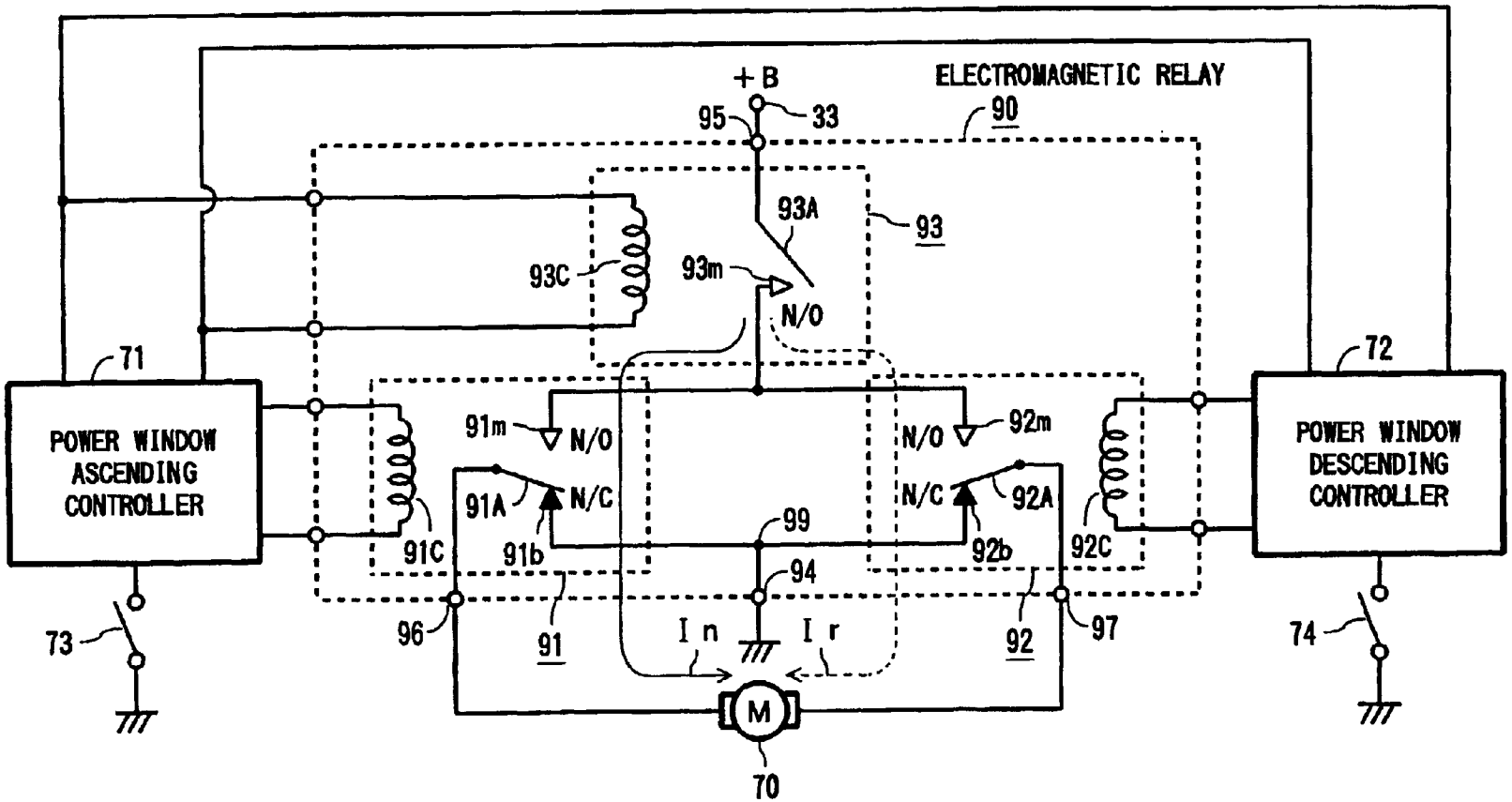
FIG. 18 is a schematic circuit diagram showing an electromagnetic relay and a DC motor drive circuit according to a still further embodiment of the present invention.

FIG. 18 is a schematic circuit diagram showing an equivalent circuit of an electromagnetic relay according to yet a further embodiment of the present invention used when the present invention is applied to a power window drive section and a DC motor drive circuit using this electromagnetic relay to drive the power window drive section.

As shown in FIG. 18, an electromagnetic relay 90 according to this embodiment includes a housing for incorporating three relay sections 91, 92, 93 therein.

Referring to FIG. 18, the first relay section 91 is comprised of a normally closed contact 91*b*, a normally open contact 91*m*, a movable contact 91A and a coil 91C for operating the movable contact 91A. The second relay section 92 is comprised of a normally closed contact 92*b*, a normally open contact 92*m*, a movable contact 92A and a coil 92C for operating the movable contact 92A. Further, the third relay section 93 is comprised of a normally open contact 93*m*, a movable contact 93A and a coil 93C for operating the movable contact 93A.

The normally open contacts 91*m*, 92*m*, 93*m* of the first, second, third relay sections 91, 92, 93 are electrically connected to each other within the housing of the electromagnetic relay 90. However, no terminal is led out from the common connection portion of these normally open contacts 91*m*, 92*m*, 93*m* to the outside of the housing of the electromagnetic relay 90.

The first normally closed contact 91*b* of the first relay section 91 and the normally closed contact 92*b* of the second relay section 92 are connected with each other. A common normally closed terminal 94 is led out from a connection point 99 between the first normally closed contact 91*b* and the normally closed contact 92*b*. Movable contact terminals 96, 97, 95 are led out from the movable contact 91A of the first relay section 91, the movable contact 92A of the second relay section 92 and the movable contact 93A of the third relay section 93 to the outside of the housing of the electromagnetic relay 90, respectively.

In this embodiment shown in FIG. 18, one end of the power window DC motor 70 is connected to the movable contact terminal 96 of the first relay section 91. The other end of the DC motor 70 is connected to the movable contact terminal 97 of the second relay section 92. The common normally open contact terminal 94 is connected to a power supply at one terminal, i.e. the ground. The movable contact terminal 95 of the third relay section 93 may be connected to the power supply at the other terminal, i.e. the power supply at the terminal 33, at which the positive DC voltage (+B) is connected from the car battery (not shown), for example.

When a user operates the power window drive section to move the power window upward, the coil 91C of the first relay section. 91 is energized by controlling current responsive to such user's operation and the coil 93C of the third relay section 93 also is energized by the above controlling current from the power window ascending controller 71. When the user operates the power window drive section to move the power window downward, the coil 92C of the second relay section 92 is energized by controlling current responsive to such user's operation and the coil 93C of the third relay section 93 also is energized by the above controlling current from the power window descending controller 72.

While the user is operating the power window drive section to move the power window upward, a switch 73 is being actuated during a time period in which the user is operating the power window drive section, for example, so that the coils 91C, 93C of the first and third relay sections 91, 93 are energized by the controlling current from the power window ascending controller 71, permitting the movable contacts 91A, 93A of the first and third relay sections 91, 93 to be connected to the normally open contacts 91*m*, 93*m* nearly simultaneously in unison with each other. Therefore, direct current flows through the DC motor 70 in the direction shown by a solid-line arrow In in FIG. 18 and thereby the DC motor 70 can be driven in the positive direction. Thus, the power window of the automobile can be moved upward.

When the user stops operating the power window drive section to move the power window upward, the switch 73 is returned to the OFF position so that the coils 91C, 93C of the first and third relay sections 91, 93 are not energized by the controlling current. As a result, the movable contacts 91A, 93A are returned to the original state nearly at the same time in unison with each other. Thus, the DC motor 70 can be braked and the upward movement of the power window of the automobile can be stopped.

When the user is operating the power window drive section to move the power window downward, a switch 74 is being actuated during a time period in which the user is operating the power window drive section so that the coils 92C, 93C of the second and third relay sections 92, 93 are energized by the controlling current from the power window descending controller 72, permitting the movable contacts 92A, 93A of the second and third relay sections 92, 93 to be respectively connected to the normally open contacts 92*m*, 93*m* nearly simultaneously in unison with each other. Therefore, a direct current flows through the DC motor 70 in the direction shown by a dashed-line arrow Ir in FIG. 18 and thereby the DC motor 70 can be driven in the opposite direction. Thus, the power window of the automobile can be moved downward.

When the user stops operating the power window drive section to move the power window downward, the switch 74 is returned to the OFF position so that the coils 92C, 93C of the second and third relay sections 92, 93 are not energized by the controlling current. As a consequence, the movable contacts 92A, 93A of the second and third relay sections 92, 93 are respectively returned to the original state nearly at the same time in unison with each other. Thus, the DC motor 70 can be braked and the downward movement of the power window of the automobile can be stopped.

As will be understood from the above explanation, also in this embodiment, since the normally open contact N/O of the first or second relay section 91 or 92 is connected through the normally open contact N/O of the third relay section 93 to the power supply, at the terminal 33, the two normally open contacts N/O can be connected in series to the current path of the direct current In or Ir which flows through the DC motor 70.

Therefore, similarly to the aforementioned embodiments, even though the contact gap length of each contact group is reduced, it becomes possible to overcome the disadvantage of the short-circuit caused between the normally closed contact N/C and the normally open contact N/O due to the arc.

Figure 19:
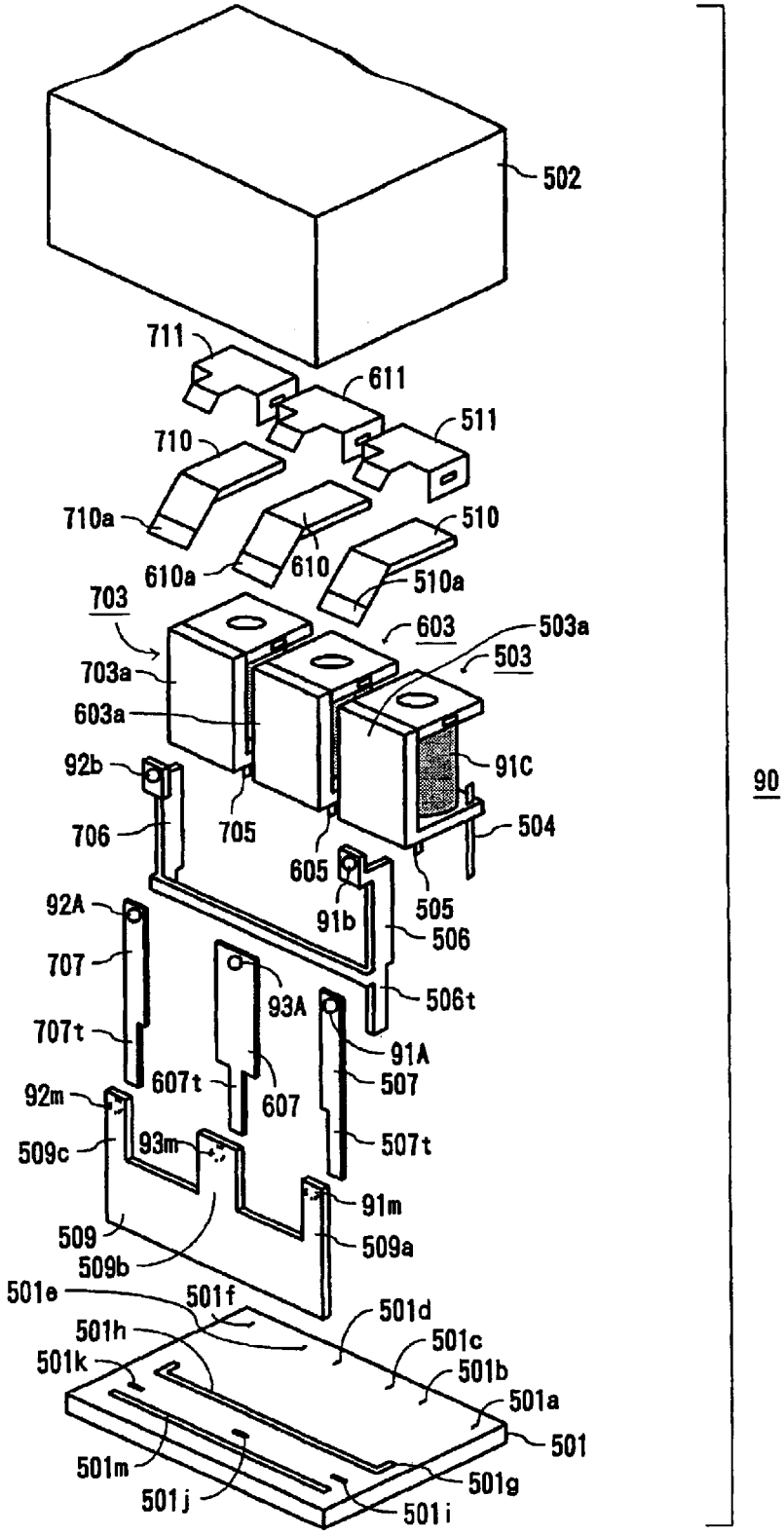
FIG. 19 is an exploded, perspective view showing an example of the structure of the electromagnetic relay shown in FIG. 18.

FIG. 19 is a perspective view showing an example of the structure of the power window ascending/descending drive and control electromagnetic relay 90 shown in FIG. 18, and illustrates the assemblies of the electromagnetic relay 90 in an exploded fashion. In FIG. 19, elements and parts identical to those of FIG. 18 are denoted with identical reference numerals.

Assemblies of the electromagnetic relay 90 shown in FIG. 19 are assembled on a terminal board 501, and finished assemblies are covered with a cover 502 when the cover 502 is joined with the terminal board 501. The housing of the electromagnetic relay 90 is comprised of the terminal board 501 and the cover 502.

Figure 20:
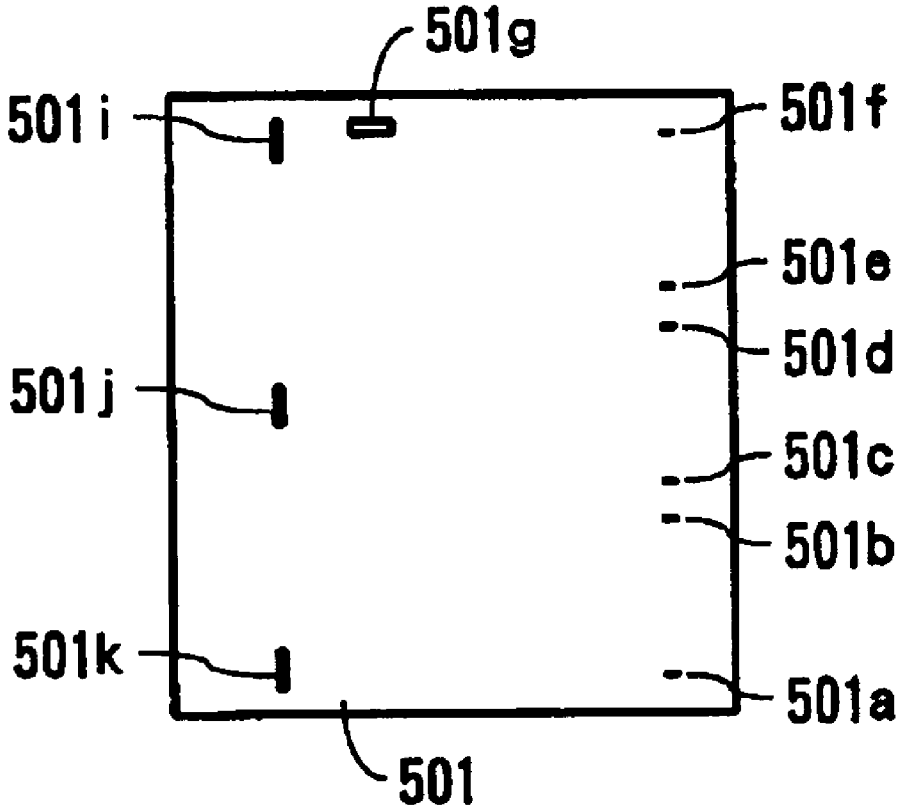
FIG. 20 is a rear view showing a part of the electromagnetic relay shown in FIG. 19.

FIG. 20 is a rear view of the terminal board 501 and shows through-holes 501*a*, 501*b*, 501*c*, 501*d*, 501*e*, 501*f*, 501*g*, 501*i*, 501*j*, 501*k* from which terminals are led out to the outside of the housing of the electromagnetic relay 90.

In FIG. 19, parts denoted by reference numerals 500*s* following reference numeral 503 identify parts in which the first relay section 91 is formed. Parts denoted by reference numerals 600*s* following reference numeral 603 identify parts in which the third relay section 93 is formed. Parts denoted by reference numerals 700*s* following reference numeral 703 identify parts in which the second relay section 92 is formed.

As shown in FIG. 19, the electromagnetic relay 90 includes an electromagnet assembly 503 of the first relay section 91, an electromagnet assembly 703 of the second relay section 92 and an electromagnet assembly 603 of the third relay section 93. The electromagnet assemblies 503, 703, 603 include L-shaped yokes 503*a*, 703*a*, 603*a* to support coils 91C, 92C, 93C with iron-cores.

The electromagnet assemblies 503, 603, 703 include coil terminals 504, 505, 604, 605 and 704, 705, each made of a conductive material, to which one end and the other end of each of the coils 91 C, 93C, 92C are connected, respectively. These coil terminals 504, 505, 604, 605, 704, 705 are extended through the terminal board 501 from the through-holes 501*a*, 501*b*, 501*c*, 501*d*, 501*e*, 501*f* to the outside of the housing of the electromagnetic relay 90.

As shown in FIG. 19, a normally closed contact plate 506 is a conductive contact plate with the normally closed contact 91*b* of the first relay section 91 formed thereon. A normally closed contact plate 706 is a conductive contact plate with the normally closed contact plate 92*b* of the second relay section 92 formed thereon.

In this embodiment, these normally closed contact plates 506, 706 are joined to each other as an integrated element and are also electrically connected to each other. A normally closed contact terminal 506*t* is integrally formed with the above integrated element of the normally closed contact plates 506, 706. The normally closed contact terminal 506*t* is extended through the through-hole 501*g* to the outside of the housing of the electromagnetic relay 90. A portion at which the normally closed contact plates 506, 706 are joined is fitted into a concave groove 501*h* formed on the terminal board 501.

The first relay section 91 includes a movable contact spring 507 made of a conductive material. The movable contact 91A is formed on the movable contact spring 507. In this embodiment, a movable contact terminal 507*t* is integrally formed with the movable contact spring 507. The movable contact terminal 507*t* is extended through the terminal board 501 from the through-hole 501*i* to the outside of the housing of the electromagnetic relay 90.

The second relay section 92 includes a movable contact spring 707 made of a conductive material. The movable contact 92A is formed on the movable contact spring 707. In this embodiment, a movable contact terminal 707*t* is integrally formed with the movable contact spring 707. The movable contact terminal 707*t* is extended through the terminal board 501 from the through-hole 501*k* to the outside of the housing of the electromagnetic relay 90.

The third relay section 93 includes a movable contact spring 607 made of a conductive material. The movable contact 93A is formed on the movable contact spring 607. In this embodiment, a movable contact terminal 607*t* is integrally formed with the movable contact spring 607. This movable contact terminal 607*t* is extended through the terminal board 501 from the through-hole 501*j* to the outside of the housing of the electromagnetic relay 90.

A common normally open contact plate 509 is made of a conductive material and made common to the first, second and third relay sections 91, 92, 93 of the electromagnetic relay 90.

Specifically, the common normally open contact plate 509 includes a normally open contact portion 509*a* with the normally open contact 91*m* of the first relay section 91 formed thereon, a normally open contact portion 509*c* with the normally open contact 92*m* of the second relay section 92 formed thereon and a normally open contact portion 509*c* with the normally open contact 93*m* of the third relay section 93 formed thereon.

Specifically, the normally open contact 91*m* of the first relay section 91, the normally open contact 92*m* of the second relay section 92 and the normally open contact 93*m* of the third relay section 93 are integrally formed on the common normally open contact plate 509 arranged as the single common conductive plate portion and thereby electrically connected to the common normally open contact plate 509 in common.

Although the common normally open contact plate 509 is fitted into a concave groove 501*m* formed on the terminal board 501, no terminal is led out from this common normally open contact plate 509 to the outside of the housing of the electromagnetic relay 90.

In the first relay section 91, an armature 510 made of a magnetic material is attached to the electromagnet assembly 503 by. means of a hinge spring 511. The armature 510 is attracted toward the electromagnet assembly 503 by a magnetic attraction from an electromagnet created when the coil 91C is energized by current, and displaces the movable contact spring 507 toward the common normally open contact plate 509.

In the second relay section 92, an armature 710 made of a magnetic material is attached to an electromagnet assembly 703 by means of a hinge spring 711. The armature 710 is attracted toward the electromagnet assembly 703 by a magnetic attraction from an electromagnet created when the coil 92C is energized by current, and displaces the movable contact spring 707 toward the common normally open contact plate 509.

Further, in the third relay section 93, an armature 610 made of a magnetic material is attached to an electromagnet assembly 603 by means of a hinge spring 611. The armature 610 is attracted toward the electromagnet assembly 603 by a magnetic attraction from an electromagnet created when the coil 93C is energized by current, and displaces the movable contact spring 607 toward the common normally open contact plate 509.

With the above arrangement of the electromagnetic relay 90, in the first to third relay sections 91 to 93, under the condition that any of the coils 91C to 93C is not energized by current, the armatures 510, 610, 710 are not attracted by a magnetic attraction from the electromagnets. As a consequence, the movable contact springs 507, 607, 707 are not displaced toward the common normally open contact plate 509. Therefore, the movable contact 91A is connected to the normally closed contact 91*b*, the movable contact 92A is connected to the normally closed contact 92*b* and the movable contact 93A is separated from the normally open contact 93*m*.

When the user operates the power window drive section to move the power window upward, as shown in FIG. 18, the coils 91C, 93C of the first and third relay sections 91, 93 are energized by current supplied from the power window ascending controller 71 so that the armatures 510, 610 are attracted toward the electromagnet assemblies 503, 603. As a result, armature card-like portions 510*a*, 610*a* of the armatures 510, 610 resiliently displace the movable contact springs 507, 607 toward the common normally open contact plate 509. Therefore, the movable contact 91A and the normally open contact 91*m* are connected to each other and the movable contact 93A and the normally open contact 93*m* are connected to each other.

Therefore, the two normally open contacts 91*m*, 93*m* can be connected in series between the movable contact terminal 507*t* of the movable contact spring 507 and the movable contact terminal 607*t* of the movable contact spring 607.

When the coils 91C, 93C are not energized by current, the resilient displacement force exerted upon the movable contact springs 507, 607 by the armatures 510, 610 is withdrawn so that the movable contact springs 507, 607 are returned by their own spring force to the original state in which the movable contact springs 507, 607 separate from the normally open contacts 91*m*, 93*m* of the common normally open contact plate 509 nearly at the same time and the movable contact 91A of the first relay section 91 is connected to the normally closed contact 91*b*.

When the user operates the power window drive section to move the power window downward, as shown in FIG. 18, the coils 92C, 93C of the second and third relay sections 92, 93 are energized by current supplied from the power window descending controller 72 so that the armatures 710, 610 are attracted toward the electromagnet assemblies 703, 603. As a consequence, the armature card-like portions 710*a*, 610*a* of the armatures 710, 610 resiliently displace the movable contact springs 707, 607 toward the common normally open contact plate 509. Therefore, the movable contact 92A and the normally open contact 92*m* are connected with each other and the movable contact 93A and the normally open contact 93*m* are connected with each other.

Therefore, the two normally open contacts 91*m*, 93*m* can be connected in series between the movable contact terminal 707*t* of the movable contact spring 707 and the movable contact terminal 607*t* of the movable contact spring 607.

When the coils 92C, 93C are not energized by current, the resilient displacement force exerted upon the movable contact springs 707, 607 from the armatures 710, 610 is withdrawn so that the movable contact springs 707, 607 are returned by their own spring force to the original state in which the movable contact springs 707, 607 separate from the normally open contacts 92*m*, 93*m* of the common normally open contact plate 509 nearly at the same time and the movable contact 92A of the second relay section 92 is connected to the normally closed contact 92*b*.

As described above, the DC motor drive circuit shown in FIG. 18 and which uses the electromagnetic relay 90 according to this embodiment can achieve action and effects similar to those mentioned above. Specifically, according to this embodiment, it is possible to realize the power window ascending/descending drive and control electromagnetic relay in which the excellent arc cut-off capability can be obtained even though the contact gap length is reduced.

According to the electromagnetic relay 90 of this embodiment, since all normally open contacts of the first to third relay sections 91 to 93 are formed on the common normally open contact plate 509, the assemblies of the electromagnetic relay 90 can decrease and the electromagnetic relay 90 can be simplified in structure. In addition, the electrical connection process for electrically connecting a plurality of normally open contacts in series can be omitted.

Further, in the embodiment shown in FIG. 19, since the normally closed contacts 91*b*, 92*b* of the first and second relay sections 91, 92 are connected to each other as the common normally closed contact assembly within the housing of the electromagnetic relay 90 and the terminal 506*t* is led out from this common normally closed contact assembly as elements for use with the DC motor drive circuit shown in FIG. 18, the terminals of the electromagnetic relay 90 can decrease and the assemblies of the electromagnetic relay 90 can decrease.

Figure 21:
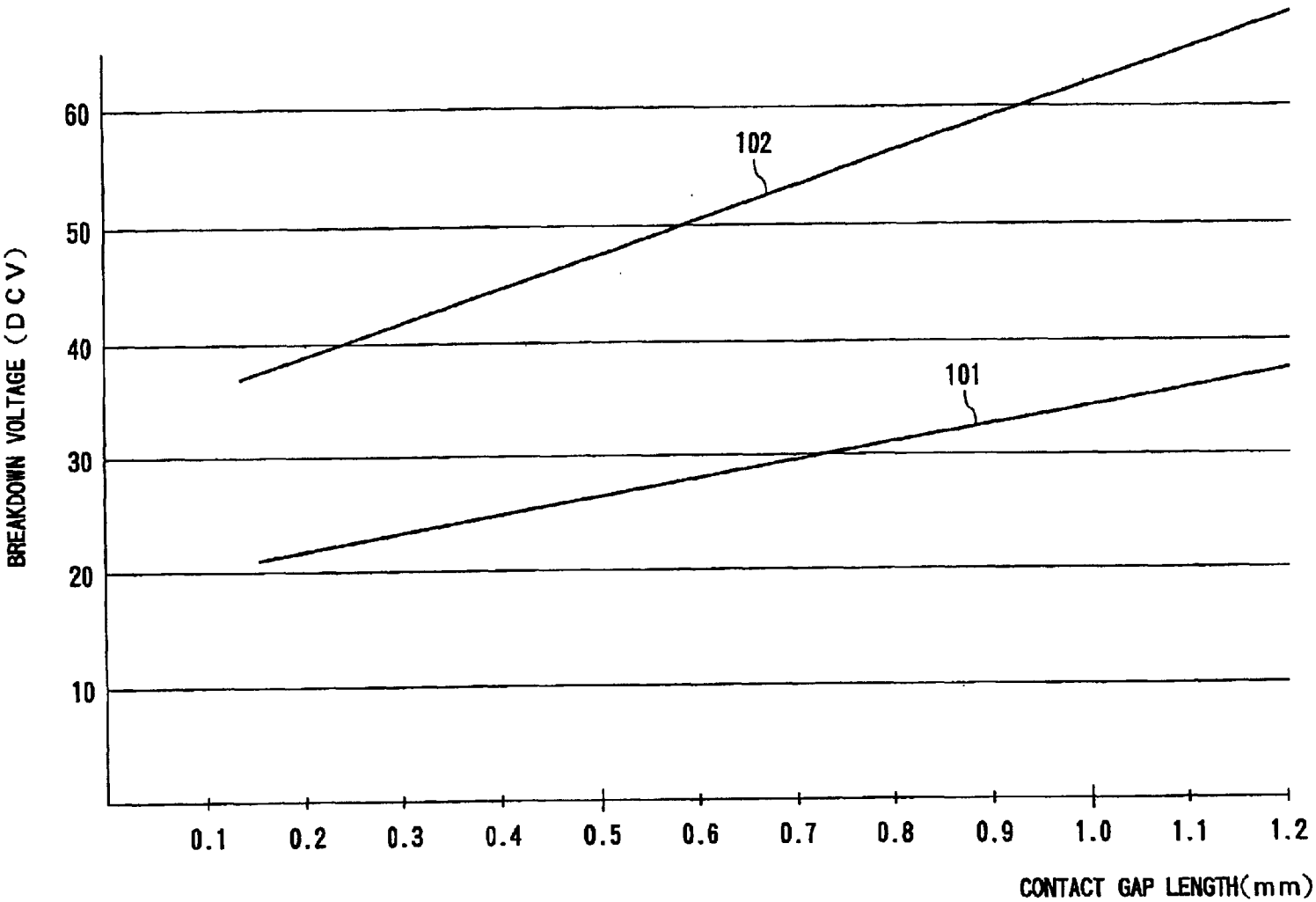
FIG. 21 is a diagram showing characteristic curves to which reference will be made in explaining the effects achieved by the present invention in comparison with those achieved by the prior-art.

FIG. 21 is a diagram showing characteristic curves to which reference will be made in explaining a relationship between a voltage (referred to as a "breakdown voltage") at which the electromagnetic relay is broken by a short-circuit between the normally closed contact N/C and the normally open contact N/O due to an arc occurring when the normally open contact N/O separates from the movable contact and the contact gap length.

Figure 1:
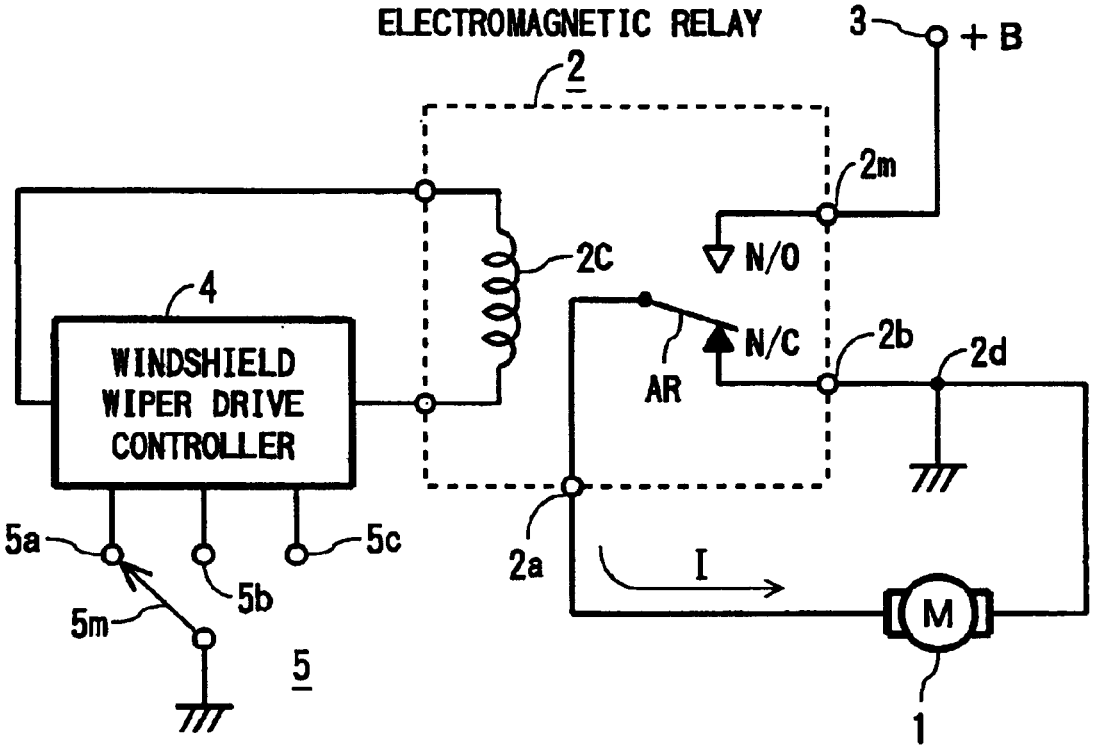
FIG. 1 (PRIOR ART)
FIG. 1 is a schematic circuit diagram showing an example of a DC motor drive circuit according to the prior art.
Figure 2:
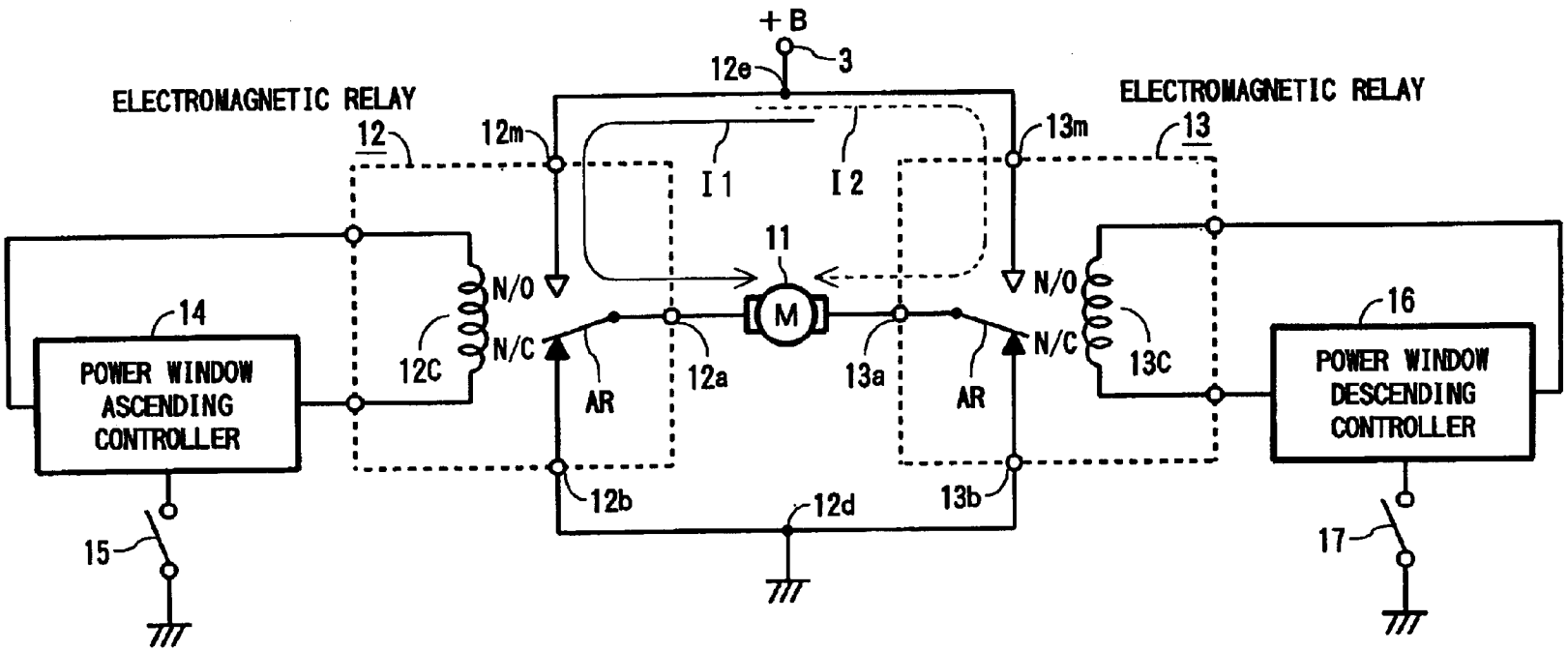
FIG. 2 (PRIOR ART)
FIG. 2 is a schematic circuit diagram showing another example of a DC motor drive circuit according to the prior art.

A solid-line characteristic curve 101 in FIG. 21 shows results obtained when the breakdown voltage and the contact gap length of the conventional electromagnetic relay shown in FIG. 1 or 2 were measured. A study of the solid-line characteristic curve 101 reveals that the electromagnetic relay for 12V having the contact gap length of 0.3 mm cannot be used for the electromagnetic relay using the DC voltage of 24V but instead, an electromagnetic relay having a long contact gap length should be used as mentioned before.

A solid-line characteristic curve 102 in FIG. 21 shows results obtained when the breakdown voltage and the contact gap length of the electromagnetic relay for use with the DC motor drive circuit according to the above-mentioned embodiments were measured wherein the two normally open contacts are connected in series to the passage of the direct current for driving the DC motor. As is clear from this solid-line characteristic curve 102, it was experimentally confirmed that, even when the battery voltage increases to a voltage as high as 42V, the electromagnetic relay is not broken by the dead short caused between the normally open contact and the normally closed contact due to the arc.

While the electromagnetic relay which includes the two contact groups has been described so far in the above-mentioned embodiments, the present invention is not limited thereto. When the present invention is applied to an electromagnetic relay including more than two contact groups, if normally open contacts of more than the two contact groups are connected in series in the passage of the direct current flowing to the DC motor, then the electromagnetic relay according to the present invention can cope with the case in which a DC power supply voltage increases much more.

Furthermore, the present invention is not limited to the windshield wiper drive section of automobile and the power window drive section of the above-mentioned embodiments. The present invention can be applied to all of DC motor drive circuits which can drive and control a DC motor by using an electromagnetic relay as described above.

As set forth above, according to the electromagnetic relay of the present invention, even when the contact gap length is reduced, the normally closed contact and the normally open contact can be protected from the short-circuit caused by the arc occurring when the movable contact separates from the normally open contact and the arc cut-off capability of the electromagnetic relay can be improved.

According to the present invention, it is possible to realize the electromagnetic relay of simple arrangement in which the arc cut-off capability can be improved.

Furthermore, the DC motor drive circuit according to the present invention can use the small electromagnetic relay with the short contact gap length even when the power supply voltage increases.

Having described preferred embodiments of the invention with reference to the accompanying drawings, it is to be understood that the invention is not limited to those precise embodiments and that various modifications and variations could be effected therein by one skilled in the art without departing from the spirit or scope of the invention as defined in the appended claims.

What is claimed is:

1. An electromagnetic relay, comprising:

a coil;

a normally closed contact;

a plurality of independent movable contacts including a movable contact which is connected to said normally closed contact when said coil is not energized;

a plurality of independent normally open contacts disposed in correspondence with said plurality of movable contacts; and an armature operated under control of an electromagnet created when said coil is energized, to thereby simultaneously displace said plurality of independent movable contacts so that said plurality of movable contacts are connected to said plurality of independent normally open contacts;

wherein said plurality of normally open contacts are electrically connected in common within a housing, said plurality of movable contacts respectively come in contact with said plurality of normally open contacts to permit said plurality of independent movable contacts to be electrically connected in series.

2. An electromagnetic relay according to claim 1, wherein said plurality of normally open contacts are integrally formed with a common normally open contact member.

3. An electromagnetic relay according to claim 1, wherein said armature includes an armature card-like member which simultaneously displaces a plurality of movable contact spring members with respective movable contacts of said plurality of independent movable contacts formed thereon under control of an electromagnet created when said coil is energized.

4. An electromagnetic relay according to claim 1, wherein said armature includes a plate-like member made of a magnetic material commonly fixed to a plurality of movable contact spring members with respective movable contacts of said plurality of movable contacts provided thereon and said plate-like member is attracted by a magnetic attraction from an electromagnet created when said coil is energized so that said plurality of movable contacts are simultaneously connected to said plurality of normally open contacts.

5. An electromagnetic relay according to claim 1, wherein no terminal is led out from said commonly connected normally open contacts to the outside of said housing.

6. An electromagnetic relay in which first and second relay sections are provided within a housing, each of said first and second relay sections comprising:

a coil;

a normally closed contact;

a plurality of independent movable contacts including a movable contact which is connected to said normally closed contact when said coil is not energized;

a plurality of independent normally open contacts disposed in correspondence with said plurality of movable contacts; and an armature operated under control of an electromagnet created when said coil is energized, to thereby simultaneously displace said plurality of independent movable contacts so that said plurality of movable contacts are connected to said plurality of independent normally open contacts;

wherein said plurality of normally open contacts of said first and second relay sections are electrically connected in common within a housing, said plurality of independent movable contacts of said first and second relay sections respectively come in contact with said plurality of normally open contacts of said first and second relay sections to permit said plurality of independent movable contacts of said first and second relay sections to be electrically connected in series.

7. An electromagnetic relay according to claim 6, wherein said plurality of normally open contacts of said first relay section and said plurality of normally open contacts of said second relay section are integrally formed with a common normally open contact member.

8. An electromagnetic relay according to claim 6, wherein each of said armatures of said first and second relay sections includes an armature card-like member which simultaneously displaces a plurality of movable contact spring members with respective movable contacts of said plurality of independent movable contacts formed thereon under control of an electromagnet created when coils of said first and second relay sections are energized.

9. An electromagnetic relay according to claim 6, wherein each of said armatures of said first and second relay sections includes a plate-like member made of a magnetic material commonly fixed to a plurality of movable contact spring members with respective movable contacts of said plurality of movable contacts provided thereon and said plate-like member is attracted by a magnetic attraction from an electromagnet created when coils of said first and second relay sections are energized so that said plurality of movable contacts are simultaneously connected to said plurality of normally open contacts.

10. An electromagnetic relay according to claim 6, wherein said normally closed contacts of said first and second relay sections are connected to each other within said housing and said normally closed contact terminals led out to the outside of said housing are integrally formed as a common normally closed contact terminal.

11. An electromagnetic relay according to claim 6, wherein said plurality of movable contacts of said first and second relay sections and which are not connected to said normally closed contacts are integrally formed as a common movable contact and said common movable contact is operated by any of said armatures of said first and second relay sections.

12. An electromagnetic relay according to claim 6, wherein no terminal is led out from said plurality of commonly connected normally open contacts to the outside of said housing.

* * * * *